US011547902B2

(12) United States Patent
Dickenson

(10) Patent No.: US 11,547,902 B2
(45) Date of Patent: Jan. 10, 2023

(54) PHYSICAL THERAPY DEVICE

(71) Applicant: Scott Dickenson, North Wales, PA (US)

(72) Inventor: Scott Dickenson, North Wales, PA (US)

( * ) Notice: Subject to any disclaimer, the term of this patent is extended or adjusted under 35 U.S.C. 154(b) by 3 days.

(21) Appl. No.: 17/335,459

(22) Filed: Jun. 1, 2021

(65) Prior Publication Data

US 2022/0379164 A1 Dec. 1, 2022

(51) Int. Cl.

| | |
|---|---|
| ***A63B 23/025*** | (2006.01) |
| ***A63B 21/04*** | (2006.01) |
| ***A63B 21/055*** | (2006.01) |
| ***A63B 21/00*** | (2006.01) |
| ***A63B 21/002*** | (2006.01) |

(52) U.S. Cl.

CPC ..... *A63B 23/025* (2013.01); *A63B 21/0023* (2013.01); *A63B 21/0414* (2013.01); *A63B 21/055* (2013.01); *A63B 21/4003* (2015.10); *A63B 21/4033* (2015.10); *A63B 21/4039* (2015.10); *A63B 21/4045* (2015.10); *A63B 2209/10* (2013.01)

(58) Field of Classification Search

CPC ..... A63B 22/20–208; A63B 21/04–0442

See application file for complete search history.

(56) References Cited

U.S. PATENT DOCUMENTS

| | | | | |
|---|---|---|---|---|
| 3,705,579 | A | 12/1972 | Morini et al. | |
| 3,771,518 | A | 11/1973 | Greissing | |
| 4,210,134 | A | 7/1980 | Okazaki et al. | |
| 4,537,393 | A | 8/1985 | Kusch | |
| 4,593,684 | A * | 6/1986 | Graham | A61H 1/0218 5/640 |
| 4,706,953 | A | 11/1987 | Graham | |
| 4,785,800 | A | 11/1988 | Stilson | |
| 5,306,232 | A | 4/1994 | Whitmyer | |
| 5,452,728 | A | 9/1995 | Iams | |
| 5,498,218 | A | 3/1996 | Proctor et al. | |
| 5,569,166 | A | 10/1996 | Stone | |
| 5,772,614 | A | 6/1998 | Lindquist | |
| 5,873,846 | A | 2/1999 | Meilus | |
| 5,993,357 | A | 11/1999 | Tom et al. | |
| 6,007,568 | A | 12/1999 | Harrell | |
| 6,042,523 | A * | 3/2000 | Graham | A63B 22/203 482/79 |
| 6,217,538 | B1 * | 4/2001 | Anderson | A61H 1/0229 602/33 |
| 6,390,997 | B1 | 5/2002 | Vitko | |
| 6,599,257 | B2 | 7/2003 | Al-Obaidi et al. | |
| 6,926,650 | B2 | 8/2005 | Endelman et al. | |

(Continued)

FOREIGN PATENT DOCUMENTS

| | | | |
|---|---|---|---|
| KR | 1020150136439 | 12/2015 | |
| WO | WO-9614810 A2 * | 5/1996 | A61F 5/04 |

*Primary Examiner* — Nyca T Nguyen

(74) *Attorney, Agent, or Firm* — Ballard Spahr LLP

(57) ABSTRACT

A device for physical therapy includes a base on which a sliding platform is mounted. One or more of a plurality of springs may be selected to act between the base and the platform to tailor the resistance of platform motion to a specific therapy or patient. The platform has a removable cushion with a friction inducing surface which a patient may use in conjunction with a friction inducing headband to perform various neck therapies and exercises.

37 Claims, 14 Drawing Sheets

(56) References Cited

U.S. PATENT DOCUMENTS 7,125,415 B1 * 10/2006 Hudgens ..... A61H 1/0296 606/241
7,163,500 B2 1/2007 Endelman et al.
7,419,459 B2 * 9/2008 Van Straaten ..... A63B 22/14 482/146
7,682,297 B2 3/2010 Graham
8,394,005 B2 3/2013 Solow et al.
8,840,528 B2 * 9/2014 Zylstra ..... A63B 21/4025 482/121
9,079,071 B2 * 7/2015 Allain ..... A63B 21/0428
9,999,803 B1 * 6/2018 Henschel ..... A63B 21/4035
10,307,284 B2 6/2019 Sudell
2003/0216230 A1 * 11/2003 Wang ..... A63B 23/0488 482/126
2006/0019806 A1 * 1/2006 Mikulski ..... A63B 23/03541 482/121
2006/0128539 A1 * 6/2006 Marquez ..... A63B 21/055 482/121
2010/0144492 A1 6/2010 Ruan
2012/0277079 A1 * 11/2012 Allain ..... A63B 21/055 482/142
2012/0295771 A1 * 11/2012 LaGree ..... A63B 22/203 482/94
2013/0217551 A1 * 8/2013 Parnell ..... A63B 21/00178 482/141
2014/0011645 A1 * 1/2014 Johnson ..... A63B 23/03525 482/121
2014/0011647 A1 * 1/2014 Lalaoua ..... A63B 21/00061 482/125
2014/0088466 A1 * 3/2014 Hansen ..... A63B 21/4015 482/129
2014/0249461 A1 9/2014 Bissell et al.
2014/0274605 A1 * 9/2014 McCanney ..... A63B 21/4035 482/129
2015/0202111 A1 * 7/2015 Byrd ..... A61H 1/0222 606/240
2016/0193098 A1 7/2016 Nichols et al.
2017/0087397 A1 * 3/2017 Lagree ..... A63B 22/0087
2018/0169464 A1 * 6/2018 Janowski ..... A63B 21/153
2018/0353806 A1 12/2018 Brask
2019/0083349 A1 3/2019 Taves
2019/0118023 A1 * 4/2019 Mahimaidas ..... A63B 21/4049
2019/0134459 A1 * 5/2019 Locchead ..... A63B 21/00065
2019/0254911 A1 8/2019 Brask
2020/0108287 A1 * 4/2020 Robinson ..... A63B 22/0087
2020/0376326 A1 * 12/2020 Lagree ..... A63B 22/0023
2021/0154078 A1 * 5/2021 Dickenson ..... A61H 1/0296
2022/0072378 A1 * 3/2022 Alpay ..... A63B 21/0552

* cited by examiner

PHYSICAL THERAPY DEVICE

FIELD OF THE INVENTION

This invention relates to devices for physical therapy.

BACKGROUND

Physical therapy and chiropractic rehabilitation for injury to the cervical spine, or neck, often revolves around a combination of exercise and manual therapy. Physical impairments such as poor neck range of motion or poor strength are addressed with exercises to stretch tight tissues, and strengthen weak neck muscles, respectively. Pain relief strategies commonly include manual therapy techniques, such as neck traction, to provide the patient with symptom relief and improve exercise tolerance. A certain failing of the prior art in this arena, is the lack of a singular neck rehabilitation tool, capable of offering both exercises for neck strength, control and range of motion, as well as providing pain relief via cervical traction and other manual therapy options. For clinical utility, this rehabilitation tool would need to be light weight and transportable, and easily adjusted between range of motion and strength exercises, and traction set up.

SUMMARY

The invention concerns a therapy device. An example embodiment of a therapy device according to the invention comprises an elongate base. A platform is mounted on the base and is movable relatively thereto lengthwise along the base. A biasing mechanism acts between the base and the platform for resisting motion of the platform relatively to the base. By way of example the biasing mechanism may be mounted on a first side of the base and a second biasing mechanism may be mounted on a second side of the base opposite to the first side. The device may further comprise a guide track positioned on the base. The guide track extends lengthwise along the base and the platform slidably engages the guide track. In a specific example the guide track comprises first and second rails mounted in spaced relation along opposite sides of the base. The first and second rails extend lengthwise along the base. In this example the platform comprises a plurality of wheels rotatably mounted on the platform in spaced relation to one another. The wheels engage the first and second rails and thereby permitting sliding motion of the platform relatively to the base.

An example device according to the invention may further comprise a substrate mounted on the platform. The platform is positioned between the substrate and the base and may comprise a cushion. An example substrate may further comprise a friction inducing surface facing away from the platform. A fastener positioned between the platform and the substrate permits removal and reattachment of the substrate to the platform. In an example embodiment the fastener comprises a hook and loop fastener having a plurality of hooks positioned on one of the platform or the substrate and a plurality of loops positioned on another of the platform or the substrate. The hooks engage the loops for releasably retaining the substrate to the platform. A handle may be attached to the base to permit easy carry.

By way of example the biasing mechanism comprises a first anchor mounted on the base and a second anchor mounted on the base in spaced relation to the first anchor. A catch is mounted on the platform and is positionable between the first and second anchors. A spring has a first end attached to the first anchor and a second end attached to the second anchor. An intermediate point of the spring between the first and second ends attaches to the catch. In a specific example embodiment the spring comprises an elastic tube. The biasing mechanism may further comprise a plurality of springs, each having a first end attached to the first anchor and a second end attached to the second anchor. Each spring further has an intermediate point between the first and second ends attachable to the catch. The springs may comprise elastic tubes. By way of example each spring has a respective spring constant, the respective spring constants being different from one another.

In a specific example embodiment the first and second anchors each comprise a gusset attached to the base. The gusset defines a plurality of openings. The opening receive the first or the second end of one of the elastic tubes. In a particular embodiment the openings comprise slots extending from an edge of the gusset. Each anchor may further comprise a respective retainer plate attached to the gusset. The retainer plate is movable between an open position providing access to the slots, and a closed position thereby closing the slots. Further by way of example, each elastic tube may comprise a first bead positioned proximate to the first end thereof and a second bead positioned proximate to the second end thereof. The beads engage respective gussets. In a further example the catch comprises a body defining a channel extending lengthwise to the base. The channel receives the intermediate point of at least one of the elastic tubes. For example embodiments wherein the elastic tube comprises a bead positioned at the intermediate point, the body may comprises a cavity intersected by the channel. The cavity receives one of the beads when one of the elastic tubes is received within the channel.

An example device according to the invention may further comprise a band positionable around a head of a patient. The band has an outwardly facing surface engageable with the friction inducing surface of the substrate. Further by way of example, the outwardly facing surface of the band may comprise a second friction inducing surface.

For certain functions an example device according to the invention may further comprise a cradle. The cradle is mountable on the platform for receiving a head of a patient. By way of example the cradle comprises a concave surface and may also comprise a strap attached to the cradle. The strap is adapted to encircle the head and cinch the head to the cradle. The cradle is mountable between the platform and a cushion positioned overlying the platform.

The invention also encompasses a method for treating rotation range of motion of a head of a patient using an example device according to the invention. An example method comprises:

- disconnecting all the springs from the catch to allow free sliding motion of the platform relatively to the base;
- with the patient supine, positioning the device perpendicular to the patient's spine and beneath the head;
- resting the head on the platform with the platform centered on the base;
- rotating the head left and right, the platform sliding beneath the head in response.

Another example method is for treating lateral flexion range of motion of a head of a patient using an example device according to the invention. An example method comprises:

- disconnecting all the springs from the catch to allow free sliding motion of the platform relatively to the base;
- with the patient supine, positioning the device obliquely to the patient's spine and beneath the head;

resting the head on the platform with the platform centered on the base;

flexing the head laterally in the direction of motion of the platform relatively to the base, thereby allowing pure frontal plane motion, the platform sliding beneath the head in response.

Positioning the device at an angle of 30° perpendicular to the patient's spine is thought to be advantageous in this example.

A method for treating flexion/extension range of motion of a head of a patient using an example device according to the invention is also encompassed by the invention. An example method comprises:

disconnecting all the springs from the catch to allow free sliding motion of the platform relatively to the base;

with the patient supine, positioning the device parallel to the patient's spine with an end of the device elevated;

with the platform centered on the base, resting the head on the platform;

flexing and extending the head, the platform sliding beneath the head in response.

Further under the invention is a method of isometric strengthening treatment of a neck of a patient using an example device according to the invention. An example method comprises:

connecting one or more the springs to the catch to resist free sliding motion of the platform relative to the base;

with the patient supine, positioning the device perpendicular to the patient's spine and beneath the head;

sliding the platform toward one end of the base against the biasing force of the spring or springs;

engaging the head with the platform;

holding the platform against the biasing force of the spring or springs, lowering the head onto the platform;

releasing the platform and holding the head in position against the biasing force of the spring or springs.

The invention also includes a method of rotational strengthening treatment of a neck of a patient using an example device according to the invention. An example method comprises:

connecting one or more of the springs to the catch to resist free sliding motion of the platform relative to the base;

with the patient supine, positioning the device perpendicular to the patient's spine and beneath the head;

resting the head on the platform with the platform centered on the base;

rotating the head in opposite directions about the transverse plane against the biasing force of the spring or springs, the platform sliding beneath the head in response.

The invention also concerns a method of rotational strengthening treatment of a neck of a patient using an example device according to the invention. An example method comprises:

connecting one or more of the springs to the catch to resist free sliding motion of the platform on the base;

with the patient supine, positioning the device perpendicular to the patient's spine and beneath the patient's head;

sliding the platform toward one end of the base against the biasing force of the springs;

engaging the head with the platform;

holding the platform against the biasing force of the spring or springs, lowering the head onto the platform;

releasing the platform and rotating the head so as to center the platform on the base;

rotating the head in an opposite direction to move the platform back toward the one end of the base.

A method of lateral flexion strengthening treatment of a neck of a patient using an example device according to the invention is also encompassed. An example method comprises:

connecting one or more of the springs to the catch to resist free sliding motion of the platform on the base;

with the patient supine, positioning the device perpendicular to the patient's spine and beneath the patient's head;

resting the patient's head on the platform with the platform centered on the base;

laterally flexing the head in opposite directions about the frontal plane against the biasing force of the springs, the platform sliding beneath the head in response.

An example method of lateral flexion strengthening of a neck of a patient using an example device according to the invention may comprise:

connecting one or more of the springs to the catch to resist free sliding motion of the platform on the base;

with the patient supine, positioning the device perpendicular to the patient's spine and beneath the patient's head;

sliding the platform toward one end of the base against the biasing force of the spring or springs;

engaging the head with the platform;

holding the platform against the biasing force of the spring or springs, lowering the head onto the platform;

releasing the platform and laterally flexing the head so as to center the platform on the base;

laterally flexing the head in an opposite direction to move the platform back toward the one end of the base.

The invention also concerns a method of flexion/extension strengthening treatment of a neck of a patient using an example device according to the invention. An example method comprises:

connecting one or more of the springs to the catch to resist free sliding motion of the platform on the base;

with the patient supine, positioning the device parallel to the patient's spine with one end of the device elevated;

resting the patient's head on the platform with the platform centered on the base;

flexing and extending the head, the platform sliding beneath the head in response.

Further under the invention is a method of mechanical traction treatment using an example device according to the invention, the example device further comprising a cradle mounted on the platform for receiving a head of a patient. An example method comprises:

positioning the cradle at one end of the platform;

with the patient supine, positioning the device parallel to the patient's spine;

resting the head within the cradle;

attaching one or more of the springs to the catch;

moving the base relative to the platform in a direction away from the patient to apply a traction force; or moving the platform relative to the base 12 in a direction toward the patient to apply the traction force; or moving the patient away from the base with the head in the cradle.

An example traction method may further comprise elevating an opposite end of the device from the one end. An example device according to the invention may further comprise a strap attached to the cradle. The strap is adapted to encircle the head and cinch the head to the cradle. An example method may further comprise tightening the strap around the head.

DETAILED DESCRIPTION

Figure 1:
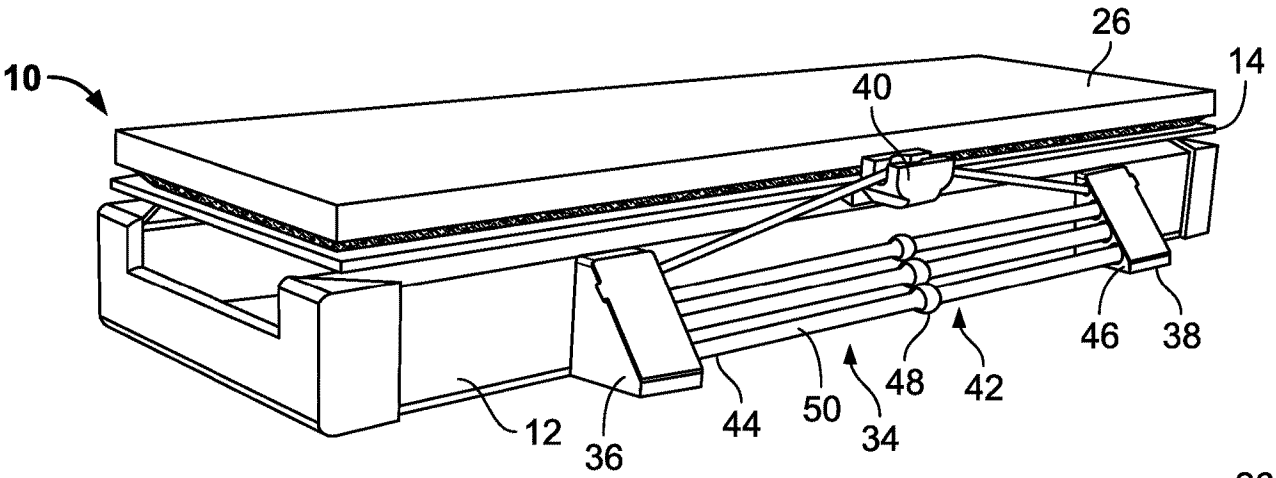
FIGS. 1 and 2 are isometric views of an example device according to the invention.
Figure 2:
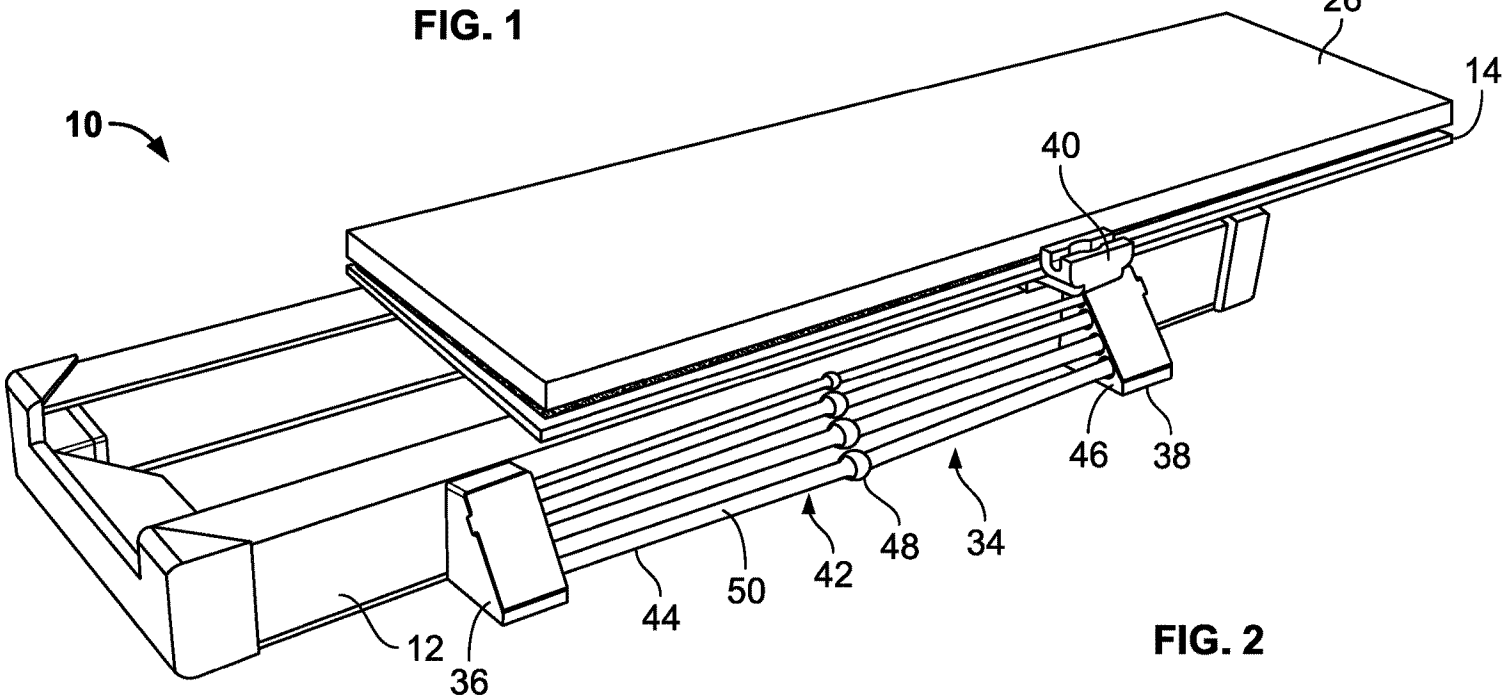
Figure 3:
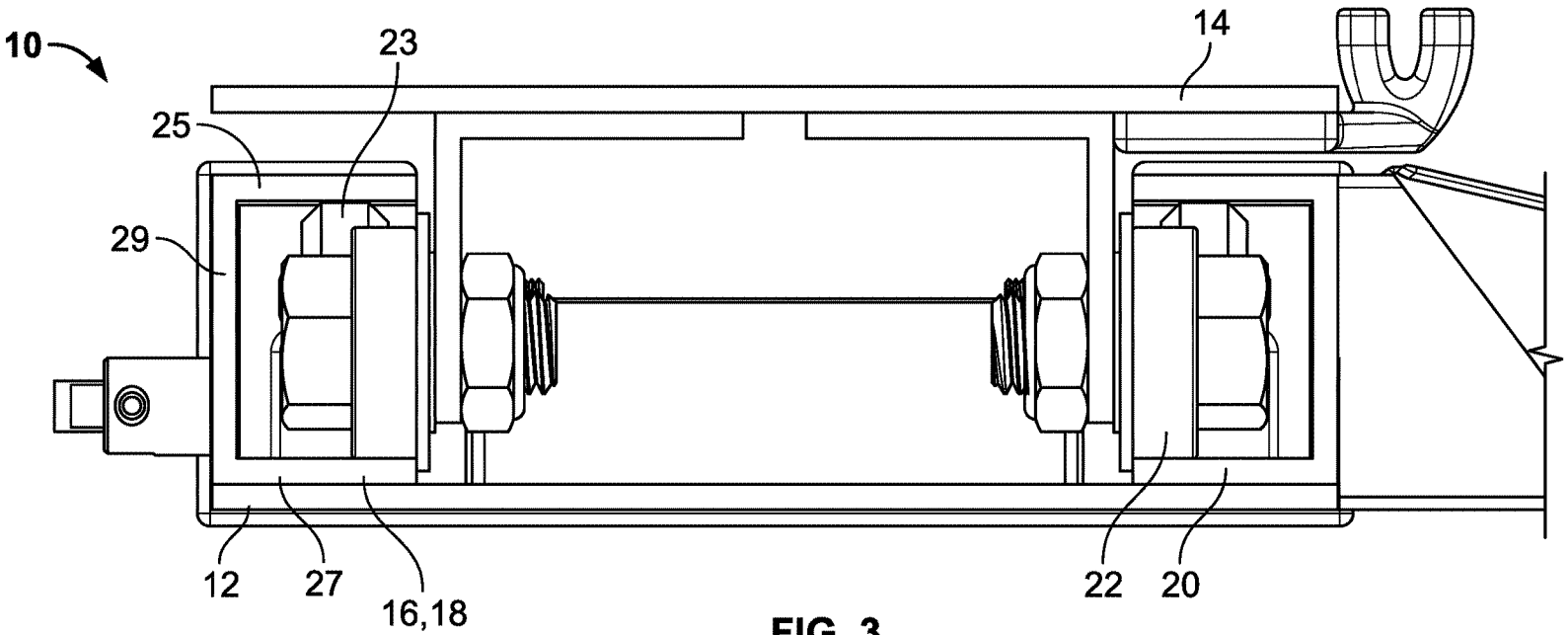
FIG. 3 is a cross sectional view of the device shown in FIGS. 1 and 2.
Figure 3A:
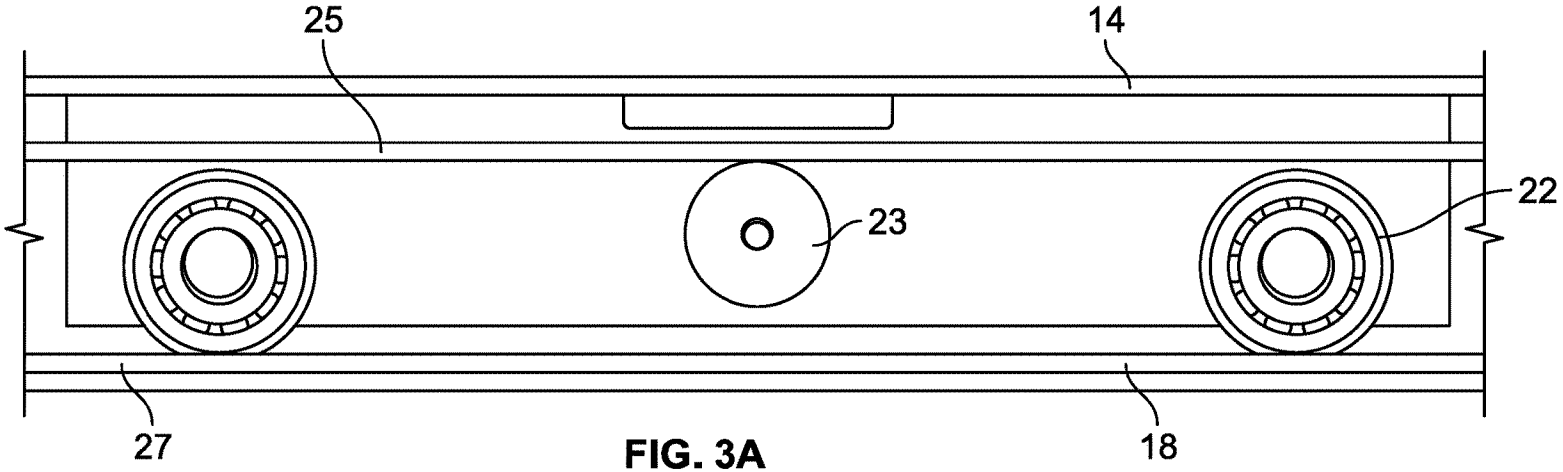
FIG. 3A is a sectional side view of the device shown in FIGS. 1 and 2.

FIGS. 1 and 2 show an example therapy device 10 according to the invention. This example device may be used for neck therapy (as shown in FIGS. 12-26) and comprises an elongate base 12 on which a platform 14 is mounted. As shown by a comparison of FIGS. 1 and 2, the platform 14 is reciprocably movable lengthwise along the base 12. As shown in FIG. 3, motion of the platform 14 occurs on a guide track 16 positioned on the base 12. The guide track 16 extends lengthwise along the base 12 and the platform 14 slidably engages it. The guide track 16 comprises first and second rails 18 and 20 mounted in spaced relation along opposite sides of the base 12. The first and second rails 18 and 20 extend lengthwise along the base 12. In this example embodiment the rails 18 and 20 comprise structural aluminum channel sections having a "C" shaped cross section with respective upper and lower flanges 25 and 27 joined by a web 29. For ease of motion a plurality of wheels 22 are rotatably mounted on the platform 14 in spaced relation to one another. In this example four flanged wheels are used to support the platform 14 and allow sliding motion relatively to the base 12. A wheel pair is positioned at each end of the platform 14 (only one wheel pair being shown). The wheels 22 engage the lower flanges 27 of the first and second rails 18 and 20 and thereby permit ready sliding motion of the platform 14 relatively to the base 12. As shown in FIG. 3A, it is thought advantageous to engage the upper flanges 25 of rails 18 and 20 (18 shown) with rollers 23 rotatably mounted on platform 14 and positioned between the wheels 22. Rollers 23 may be mounted on an eccentric bearing (not shown) attached to the platform 14. The eccentric bearing may be adjusted to force the rollers 23 against the upper flanges 25 and thereby maintain the wheels 22 engaged with the lower flanges 27 to prevent the platform from rattling against the base when device 10 is being used or transported.

Figure 8:
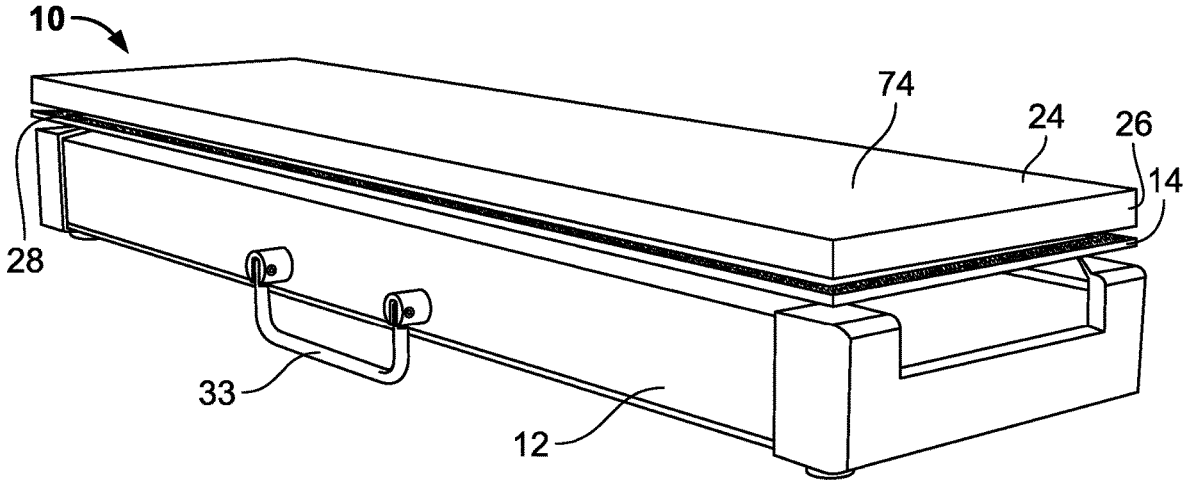
FIG. 8 is an isometric view of the device shown in FIGS. 1 and 2 from an opposite side.
Figure 9:
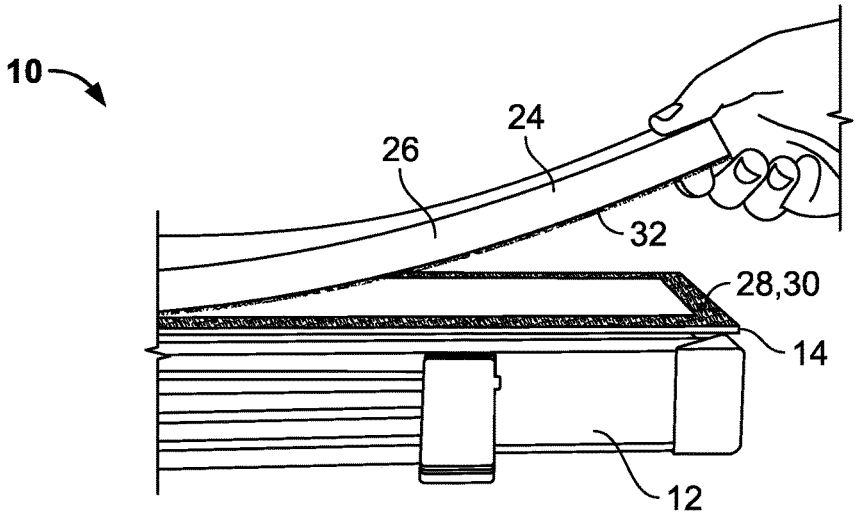
FIG. 9 is an isometric view of a portion of the device shown in FIGS. 1 and 2.

As shown in FIGS. 8 and 9, the device 10 further comprises a substrate 24 mounted on the platform 14, the platform being positioned between the substrate and the base 12. The substrate 24 advantageously comprises a cushion 26, made, for example, of foam rubber for comfort of a patient using the device 10. It is convenient that the substrate 24 be removably attached to the platform 14, for cleaning or ready replacement. Thus, as shown in FIG. 8, a fastener 28 may be positioned between the platform 14 and the substrate 24 to permit removal and reattachment of the substrate to the platform. In this example embodiment fastener 28 conveniently comprises a hook and loop fastener such as sold under the trademark Velcro®. As shown in FIG. 9, fastener 28 may thus have a plurality of hooks 30 positioned on one of the platform 14 or the substrate 24 (in this example on the platform) and a plurality of loops 32 positioned on another of the platform or the substrate (in this example on the substrate). The hooks engage the loops for releasably retaining the substrate 24 to the platform 14 as is well understood. As further shown in FIG. 8 the device 10 may also comprise a handle 33 attached to the base 12 to permit easy carry.

As shown in FIGS. 1 and 2, a biasing mechanism 34 acts between the base 12 and the platform 14 for resisting motion of the platform relatively to the base. In this example embodiment the biasing mechanism 34 comprises a first anchor 36 mounted on the base 12 and a second anchor 38 also mounted on the base but in spaced relation to the first anchor. A catch 40 is mounted on the platform 14. Catch 40 is positionable between the first and second anchors 36 and 38 during motion of the platform. Biasing mechanism 34 also includes a plurality of springs 42. Each spring 42 has a first end 44 attached to the first anchor 36, a second end 46 attached to the second anchor 38, and an intermediate point 48 between the first and second ends attachable to the catch 40.

Figure 4:
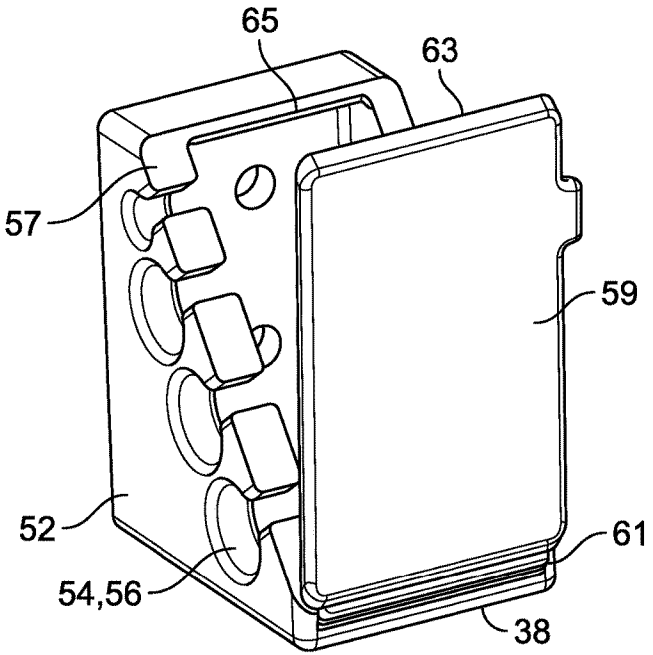
FIG. 4 is an isometric view of a component of the device shown in FIGS. 1 and 2.
Figure 6:
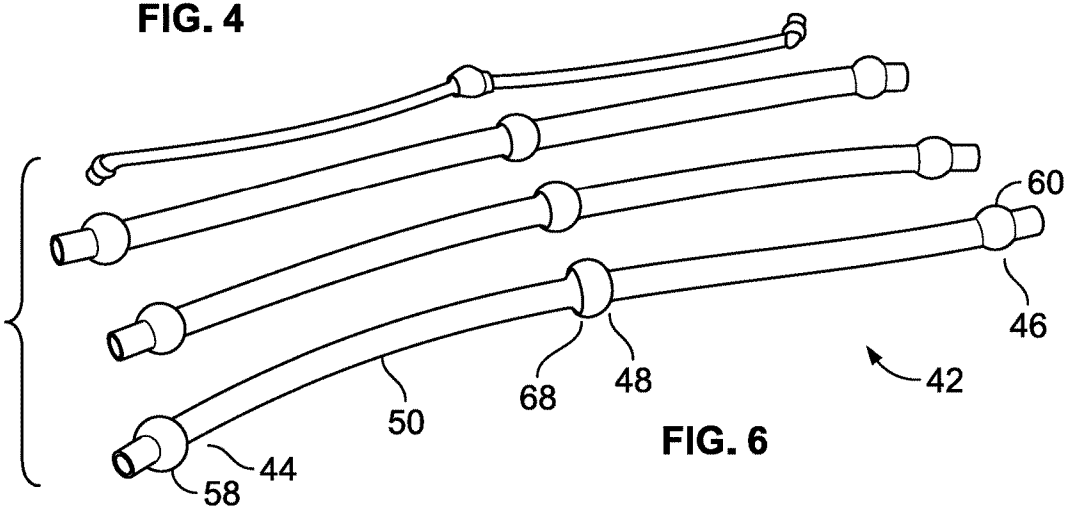
FIG. 6 is an isometric view of components of the device shown in FIGS. 1 and 2.

As shown in FIGS. 1, 2 and 6, the plurality of springs 42 comprise elastic tubes 50, in this example, four tubes. Tubes 50 may be formed from elastic material such as latex rubber. As may be deduced from FIG. 6, each spring 42 of the plurality has a respective spring constant, the respective spring constants being different from one another as manifest by the different tube diameters wherein the larger diameter indicates a larger spring constant. When elastic tubes 50 comprise the springs 42 it is convenient that the first and second anchors 36 and 38 each comprise a gusset 52 as shown in detail in FIG. 4. Gussets 52 are attached to the base 12 and define a plurality of openings 54, one for each tube 50. Each opening 54 receives the first or the second end of one of the elastic tubes. It is advantageous if the openings 54 comprise slots 56 which extend toward the base 12 from an edge 57 of the gusset 52. Slots 56 cooperate to retain the ends of the elastic tubes 50 while also permitting easy replacement of broken or spent tubes which have lost their elasticity. To provide positive mechanical engagement between the tubes 50 and the gussets 52, as shown in FIG. 6, a first bead 58 is positioned and fixed proximate to the first end 44 of each tube 50 (spring 42) and a second bead 60 positioned and fixed proximate to the second end 46 of each tube. Beads 58 and 60 are larger than the openings 56 and engage the gussets 52 to anchor the ends 44 and 46 of the tubes 50 to the base 12. Additional security for maintaining tubes 50 engaged with slots 56 may be afforded by adding a retainer plate 59 to the gusset 52. Retainer plate 59 is attached to the gusset 52 using a hinge 61 (in this example a "living hinge") allowing the retainer plate 59 to pivot between an open position (shown) exposing the edge 57 to allow access to slots 56 for adding and removing tubes 50 to the biasing mechanism 34 (see FIG. 1). Once the desired adjustment to the biasing mechanism 34 has been made the retainer plate 59 may be pivoted into the closed position to close the slots 56 and further secure the tubes 50. Retainer plate 59 may be locked closed by any of a number of means, for example, by over center engagement of interlocking surfaces between the free end 63 of retainer plate 59 and a mating edge 65 of the gusset 52.

Figure 2A:
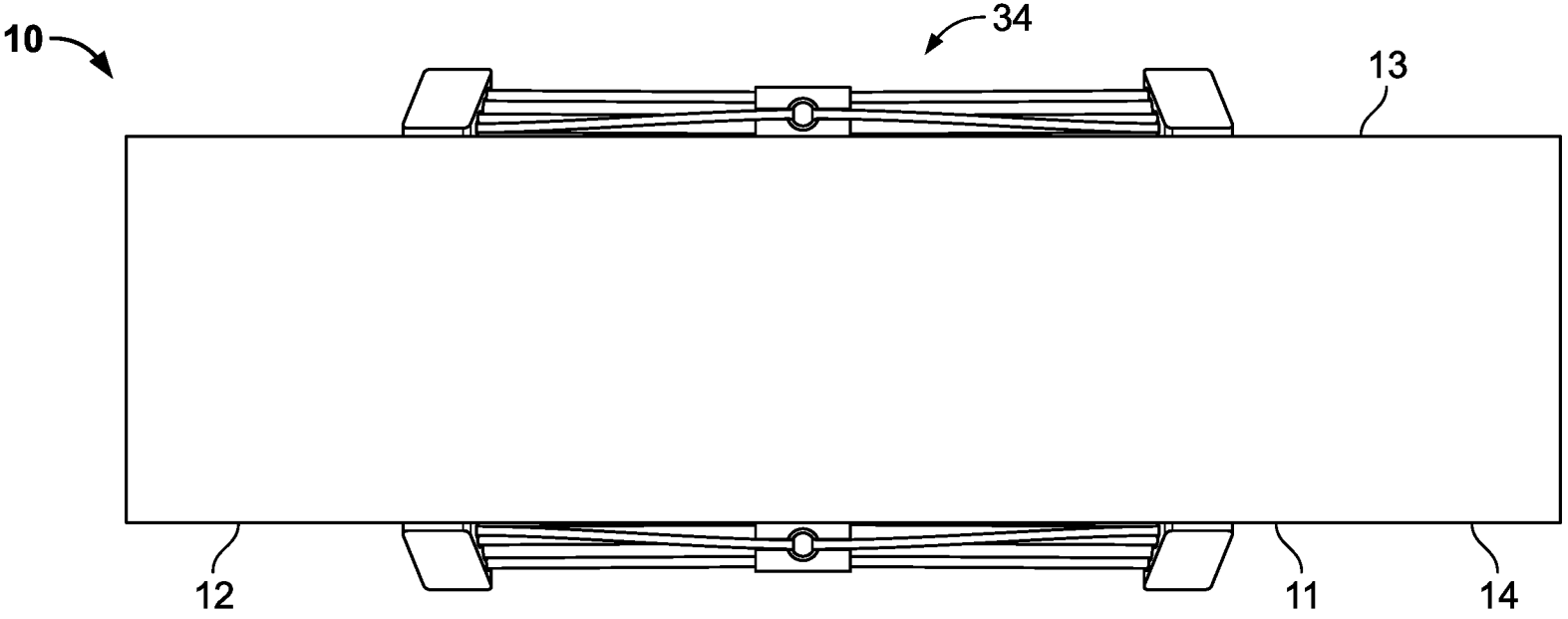
FIG. 2A is a plan view of an example device according to the invention.
Figure 5:
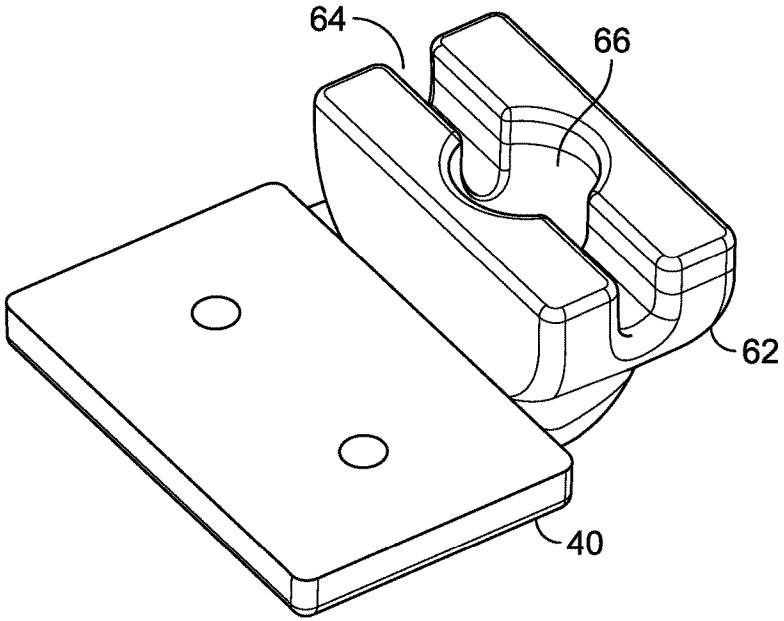
FIG. 5 is an isometric view of a component of the device shown in FIGS. 1 and 2.

Mechanical engagement between the catch 40 and the tubes 50 is effected similarly. As shown in FIG. 5, when the tubes 50 comprise springs 42, the catch 40 advantageously comprises a body 62 defining a channel 64 extending lengthwise to the base 12. Body 62 also comprises a cavity 66 intersected by the channel 64. In operation the channel 64 receives the intermediate point 48 of at least one of the elastic tubes 50 to effect spring action between the platform 14 and the base 12. Mechanical engagement is ensured because the elastic tubes 50 comprise a third bead 68 (see FIG. 6) positioned and fixed at the intermediate point 48 of each tube 50. Mechanical engagement between the tubes 50 and the body 62 (catch 40) is ensured because the cavity 66 receives the third bead 68 when an elastic tube 50 is received within the channel 64. Use of the open channel 64 and cavity 66 to affix one or more of the tubes 50 to the catch 40 allows for convenient and rapid changing of the spring constant between the platform 14 and the base 12, thereby allowing the resistance force of the device 10 to be tailored to a specific patient and a specific therapy. The versatility of device 10 may be further enhanced, as shown in FIG. 2A, by mounting a first biasing mechanisms 34 on a first side 11 of base 12 and a second biasing mechanism 34 on a second side 13 of base 12 opposite to the first side. Dual biasing mechanisms 34 on device 10 increase the number of combinations of resistance settings available, can offer greater total resistance, and also provide for the application of symmetric forces on the platform 14.

Figure 10:
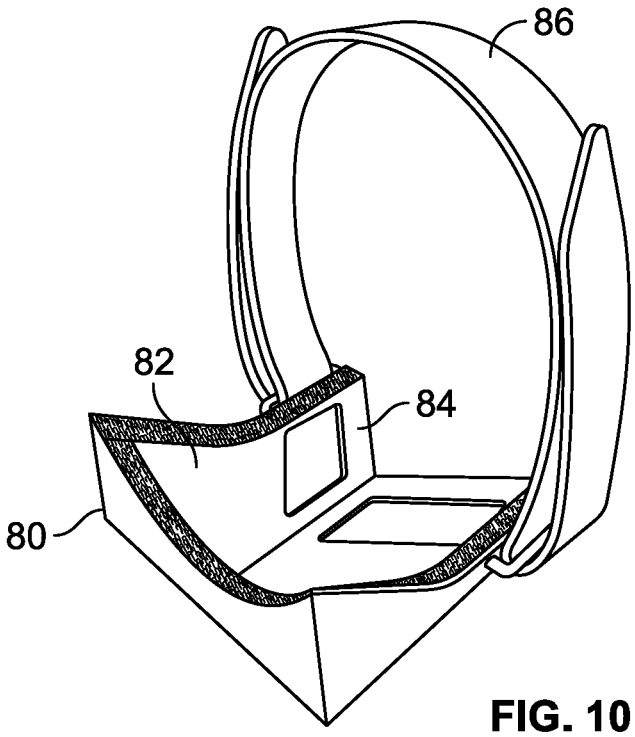
FIG. 10 is an isometric view of a component used with an example device according to the invention.
Figure 11:
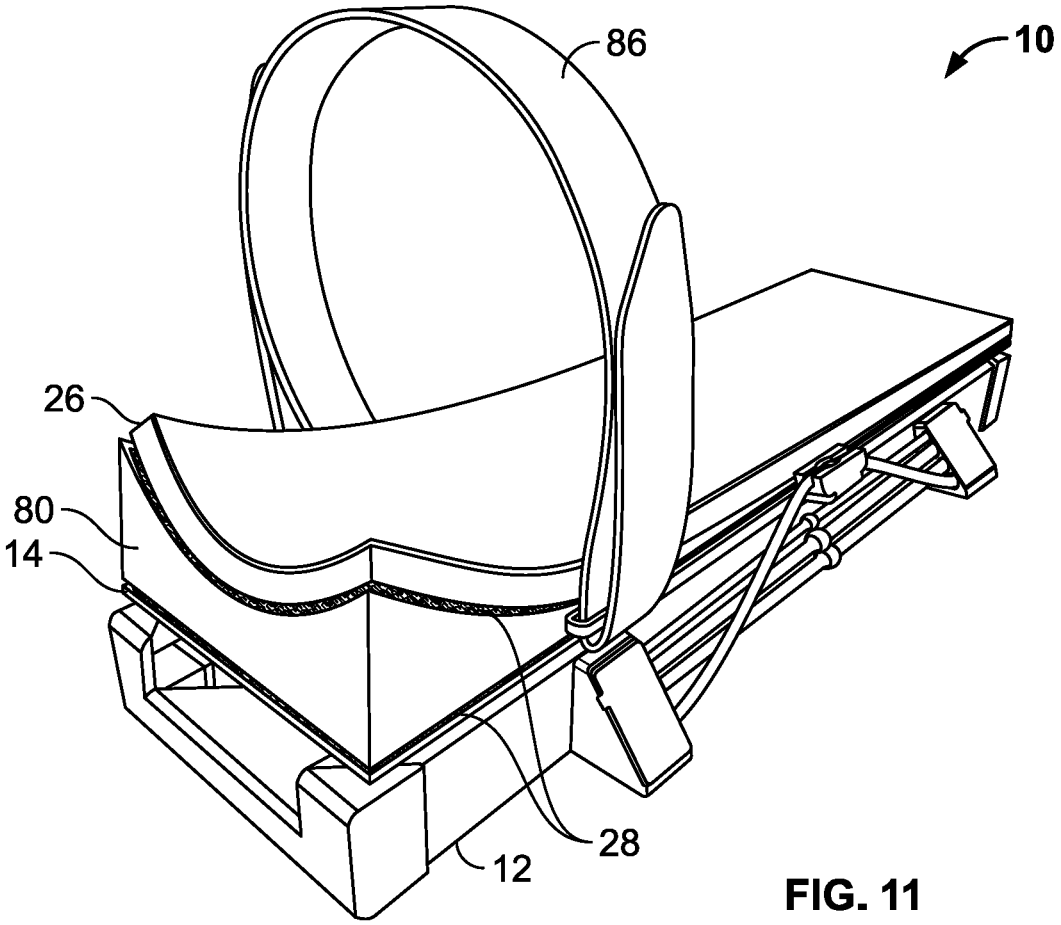
FIG. 11 is an isometric view showing the component of FIG. 10 mounted on an example device according to the invention.

FIG. 10 shows a cradle 80 which is mountable on platform 14 for traction therapy (see below). Cradle 80 comprises a concave surface 82 which cradles the back of the head of a patient (see FIG. 26) to enable traction to be applied. Cradle 80 also has a stirrup 84 to which a strap 86 may be attached. Strap 86 cinches the head to the cradle to prevent the head from riding up the concave surface and ensure that maximum traction is applied. Strap 86 may be fixed to cradle 80, or removable therefrom for independent use as a friction inducing headband 76 for other therapies (see below). As shown in FIG. 11, the cradle 80 may be removably attached to device 10 between the platform 14 and the cushion 26, a fastener 28 (such as a hook and loop fastener) may be used to secure the cradle 80 to the platform 14, and a similar fastener may be used to attach the cushion 26 to the cradle. Use of a hook and loop fastener between the cradle and the platform and the cushion and the cradle allow for easy and rapid modification of the device 10 to adapt for different therapy applications as described below.

Figure 7:
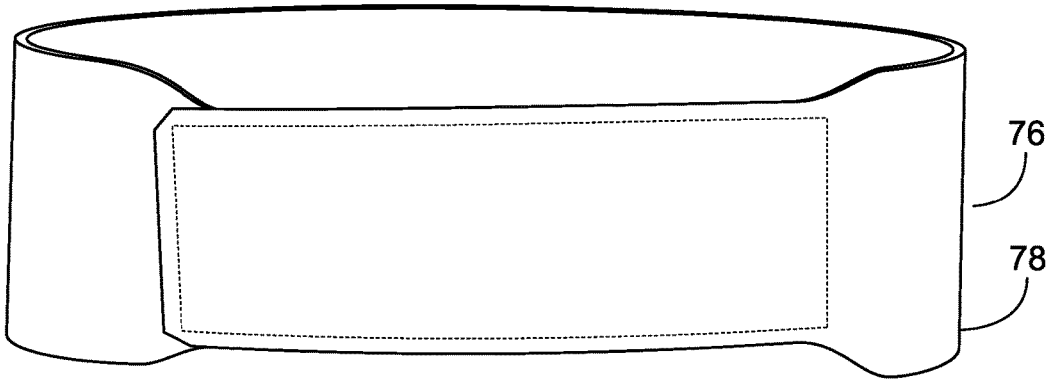
FIG. 7 is an isometric view of a component used in conjunction with the device shown in FIGS. 1 and 2.
Figure 14:
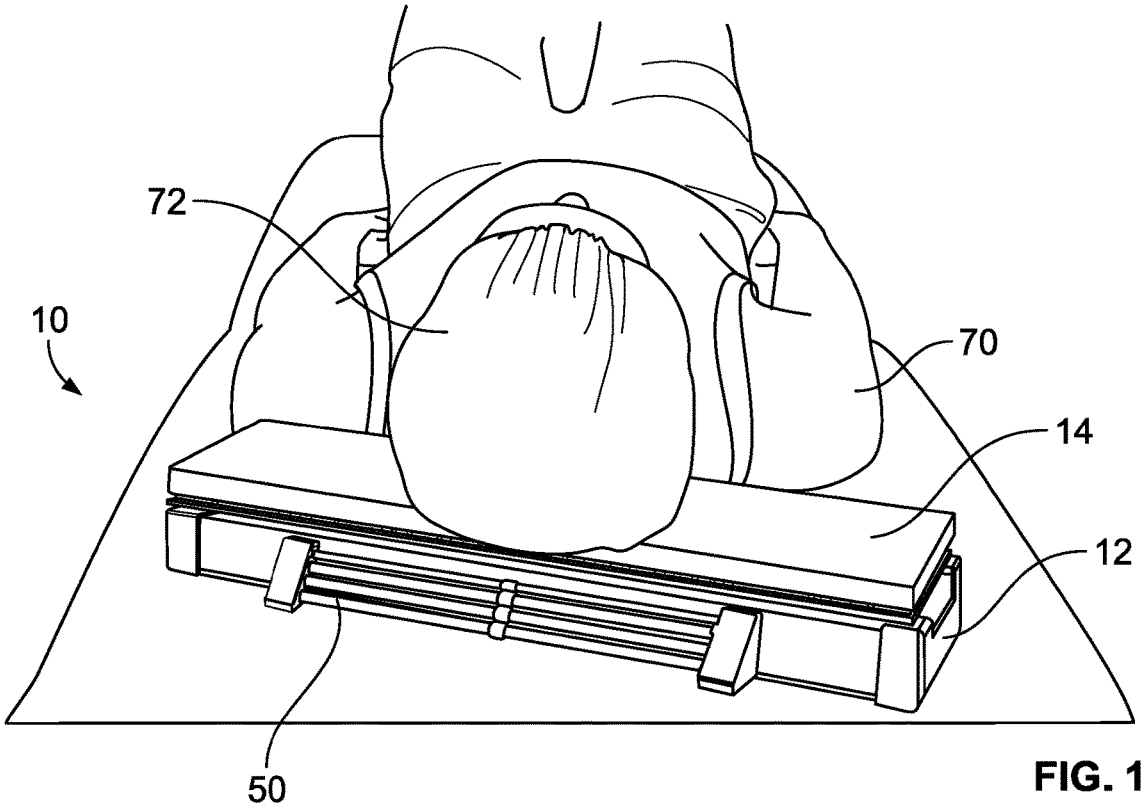
Figure 15:
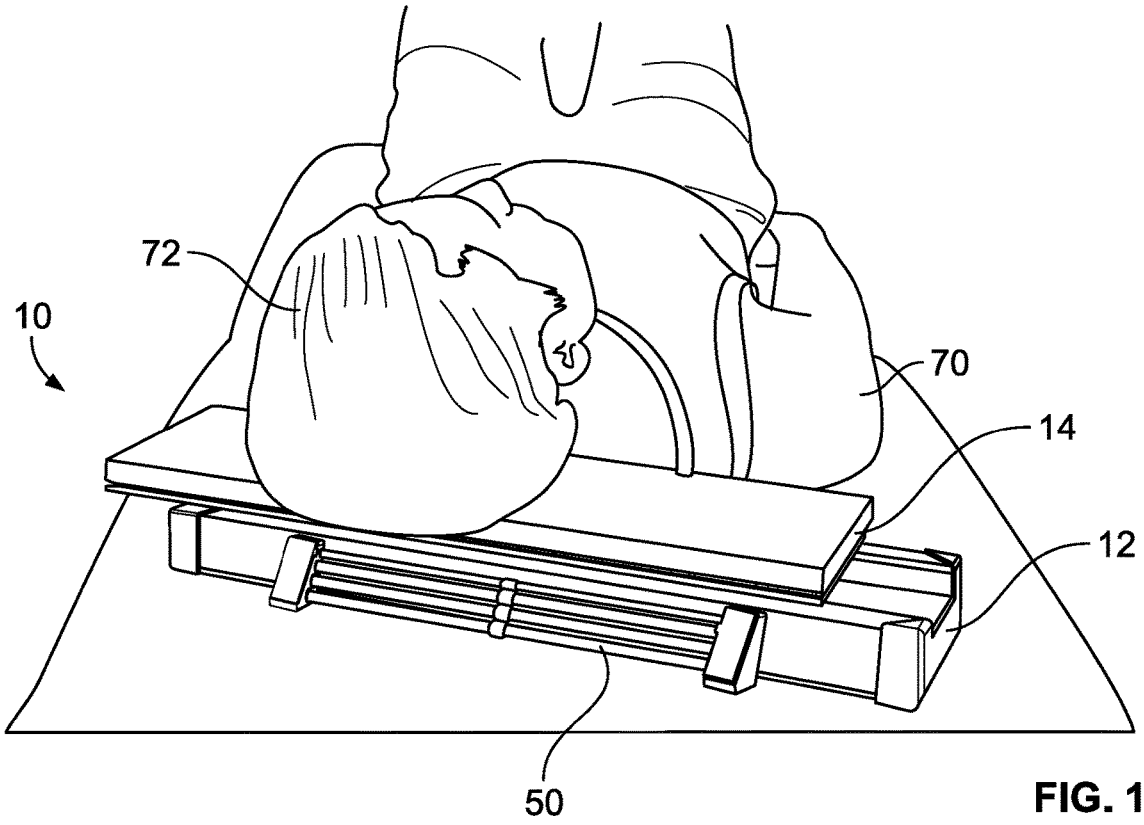

FIGS. 12-26 show the example device 10 in use. The therapies for which device 10 is expected to be effective include range of motion treatments, strengthening treatments (including isometric treatments) and traction treatment methods as outlined below. For range of motion treatments as shown in FIGS. 12-17, the biasing mechanism 34 is not engaged. To effect a strengthening treatment as shown in FIGS. 18-25, a patient 70 engages one or more of the tubes 50 with the catch 40 by inserting the third bead 68 into the cavity 66. For all range of motion treatments and strengthening treatments other than the isometric hold treatment (described below), motion of the patient's head 72 causes motion of the platform 14 relative to the base 12. For strengthening treatments platform motion is resisted by the engaged elastic tube or tubes 50 acting as a spring between the platform and the base. To increase traction between the head 72 and the platform 14 the substrate 24 may comprises a friction inducing surface 74 (see also FIG. 8). Friction inducing surface 74 may be formed from materials such as vinyl nitrile or EVA foam, faces away from the platform 14 and engages the head 72. To further augment the friction force between the head 72 and the platform 14, a band 76 may be positioned around the head of the patient. FIG. 7 shows an example band 76 in detail. Band 76 may also have an outwardly facing friction inducing surface 78 engageable with the friction inducing surface 74 of the substrate 24. Like surface 74, friction inducing surface 78 may be formed from neoprene. Note that band 76 is generally not needed for range of motion treatments as there is no significant resistance to motion due to the low friction engagement between platform 14 and base 12. Application of traction is illustrated in FIG. 26, where the platform 14 is preloaded by tensioning the platform 14 with one or more of the elastic tubes 50 while the patient's head 72 is strapped within the cradle 80 using a dedicated strap 86 or by attaching band 76 to cradle 80. Similar platform preload is also used for isometric hold treatment (FIGS. 18 and 19) described below. As shown in FIGS. 14 and 15, for certain treatments it is advantageous to orient the device 10 at an angle for patient comfort and effectiveness of the treatment.

Figure 12:
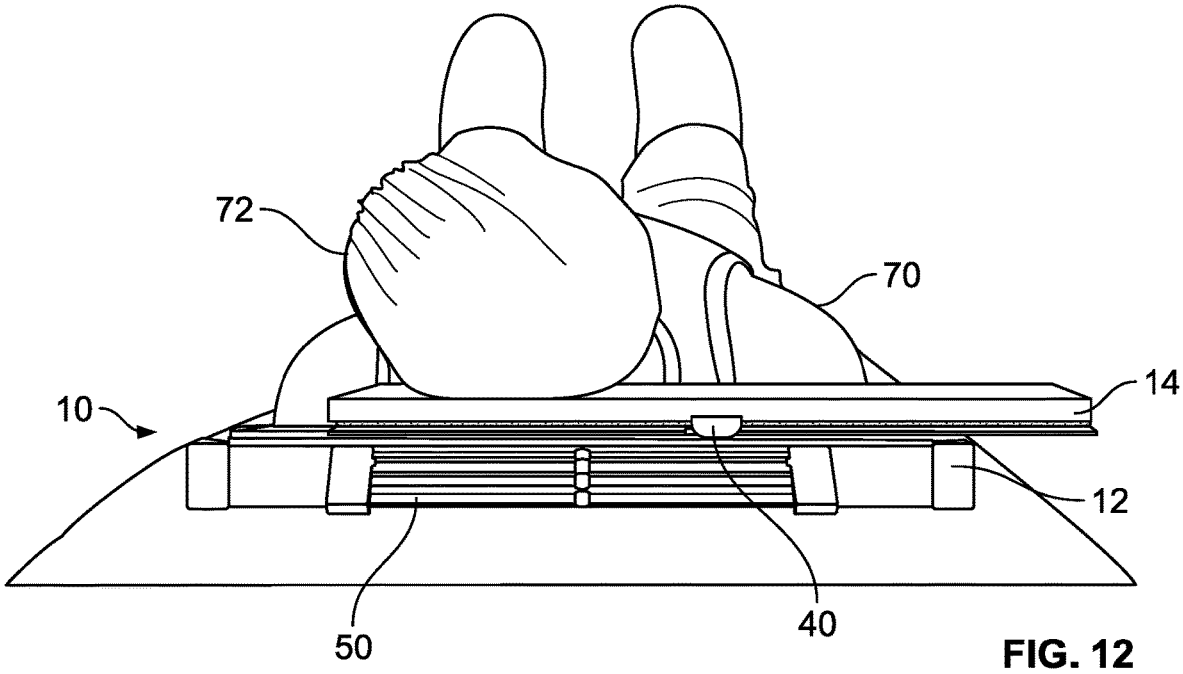
FIGS. 12-26 are isometric views showing an example device according to the invention in use.
Figure 13:
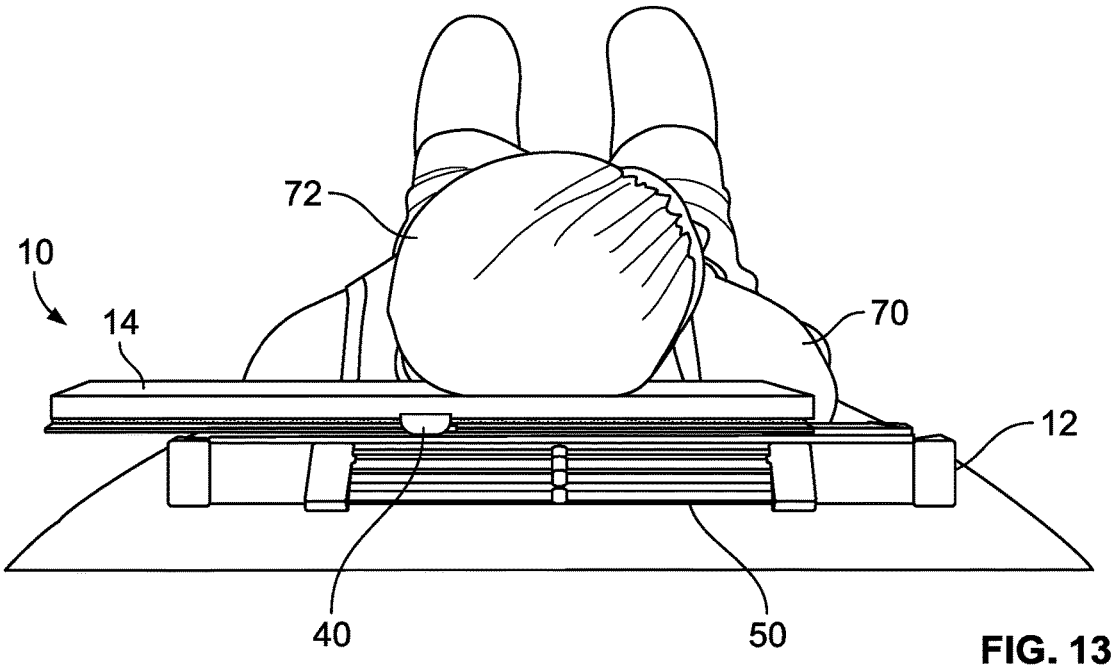

FIGS. 12 and 13 illustrate an example rotation range of motion treatment method using device 10. This example method may comprise:

- disconnecting all tubes 50 from catch 40 to allow free sliding motion of the platform 14 relatively to the base 12;
- with the patient 70 supine, positioning device 10 substantially perpendicular to the patient's spine and beneath the head 72;
- resting the patient's head (but not the neck) centered on the platform 14 with the platform centered on the base 12;
- rotating the head left and right.

As shown by a comparison of FIGS. 12 and 13, rotation of the head 72 results in platform motion in the opposite direction of head rotation, thereby allowing pure transverse plane motion. The rotational motion of the head is repeated in this gravity-eliminated position to improve range of motion and relieve pain.

FIGS. 14 and 15 illustrate an example lateral flexion range of motion treatment method using device 10. The example method may comprise:

- disconnecting all tubes 50 from catch 40 (not visible) to allow free sliding motion of the platform 14 relatively to the base 12;
- with the patient 70 supine, positioning device 10 obliquely to the patient's spine (about 30 degrees from perpendicular to the spine) and beneath the head 72 (FIG. 14);
- resting the patient's head (but not the neck) centered on the platform 14 with the platform centered on the base 12;
- flexing the head laterally (toward the side wherein the device 10 is proximate to the shoulder) in the direction of motion of platform 14 relative to base 12, thereby allowing pure frontal plane motion (FIG. 15).

This lateral flexion motion is completed one side at a time in this gravity-eliminated position, to improve range of motion and relieve pain. The device 10 is repositioned in the opposite oblique position for lateral flexion in the opposite direction.

Figure 16:
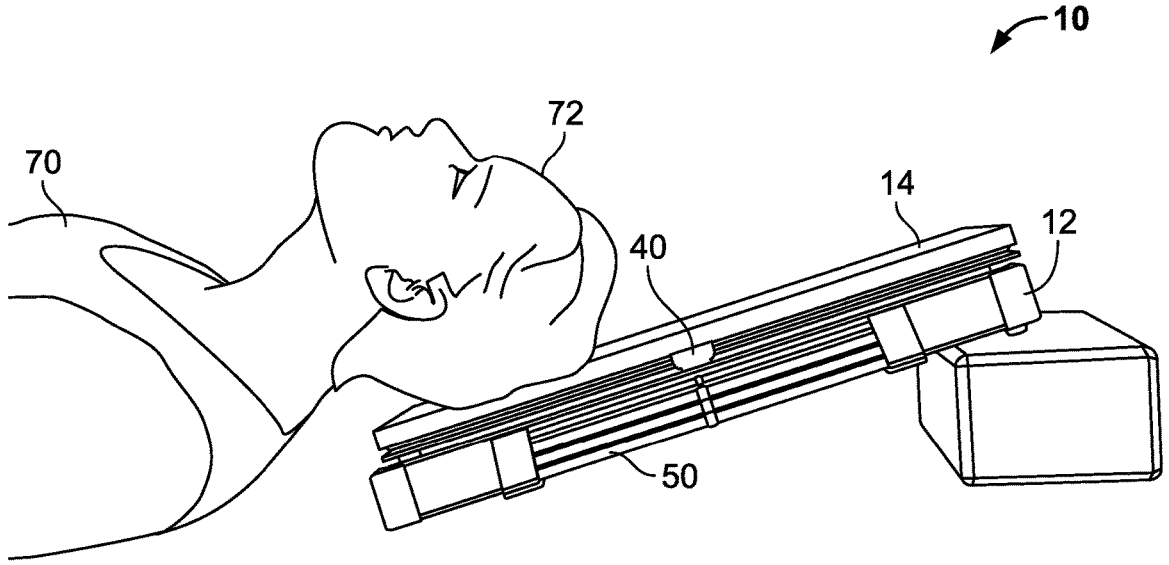
Figure 17:
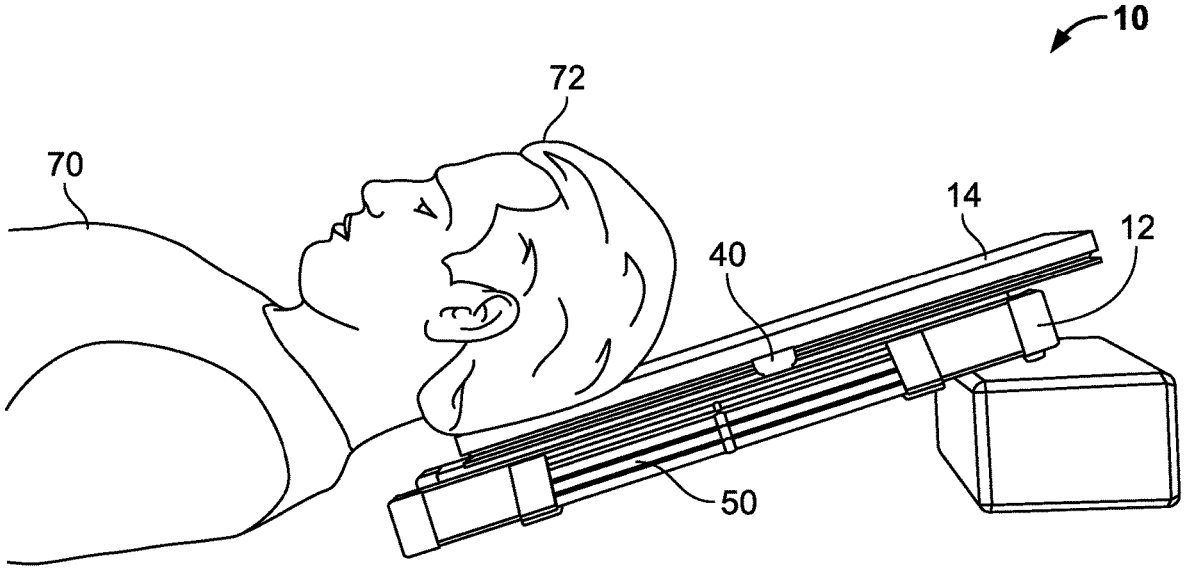

FIGS. 16 and 17 illustrate an example flexion/extension range of motion treatment using device 10. The example method may comprise:

disconnecting all tubes 50 from catch 40 to allow free sliding motion of the platform 14 on the base 12;

with the patient 70 supine, positioning device 10 parallel to the patient's spine with one end of device 10 elevated;

resting the patient's head 72 (but not the neck) on the platform 14 with the platform 14 centered on the base 12 (FIG. 16);

flexing and extending the head 72 (FIG. 17).

Flexing and extending the head results in platform motion in the opposite direction of head motion. The flexion/extension motion is repeated in this gravity-eliminated position to improve range of motion and relieve pain.

Figure 18:
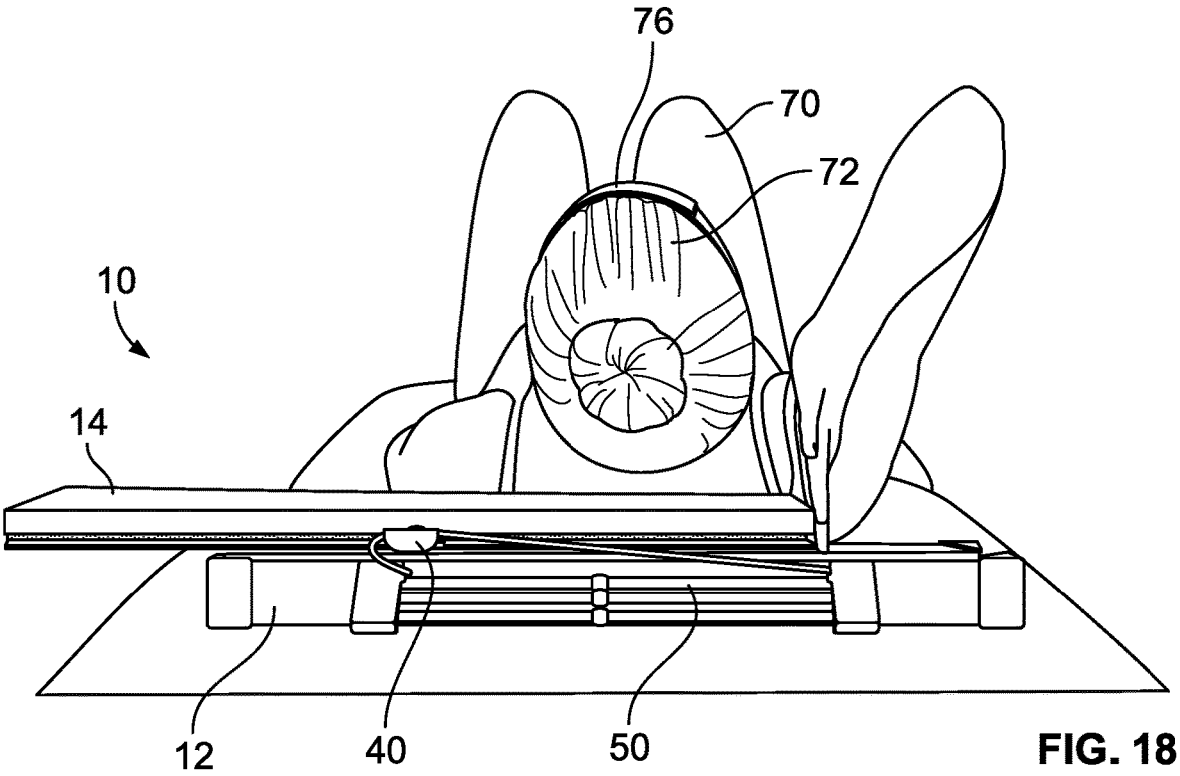
Figure 19:
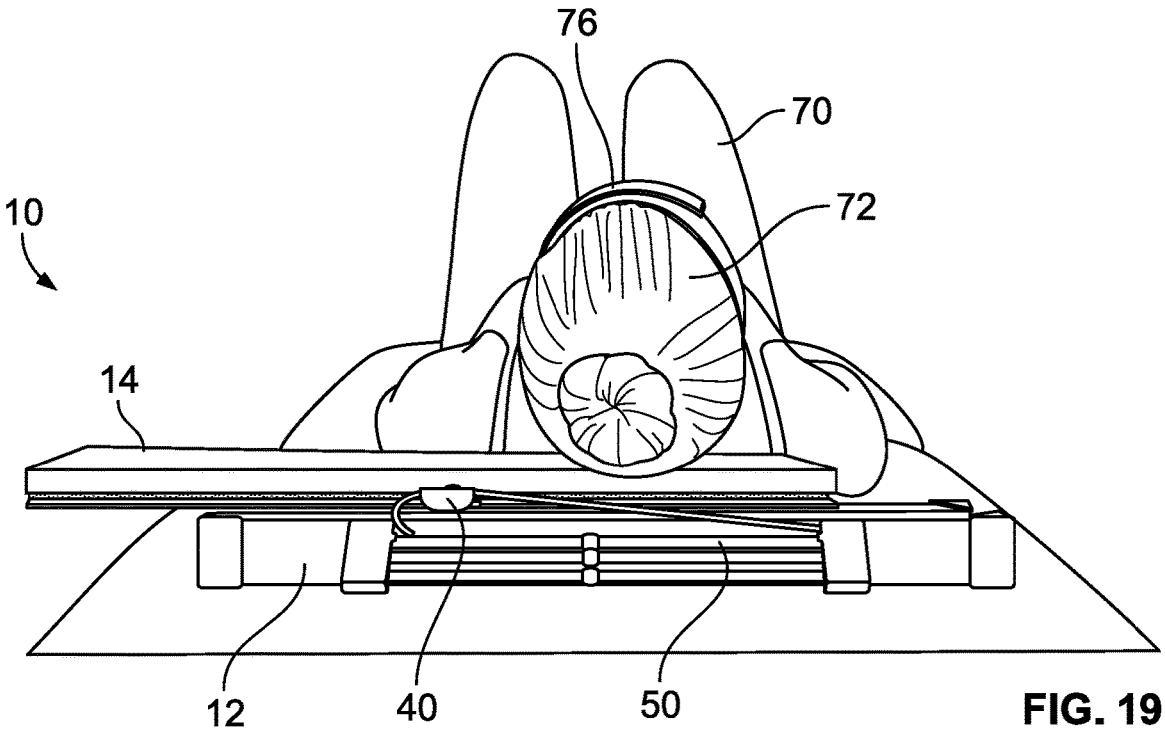

FIGS. 18 and 19 illustrate an example isometric strengthening treatment method using device 10. The example treatment may comprise:

connecting one or more tubes 50 to catch or catches 40 to resist free sliding motion of the platform 14 relative to the base 12;

with the patient 70 supine, positioning device 10 perpendicular to the patient's spine and beneath the head 72;

sliding the platform 14 toward one end of the base 12 against the biasing force of tubes 50 (FIG. 18);

engaging the head 72 with the platform 14;

holding the platform 14 against the biasing force of tubes 50, (FIG. 18);

releasing the platform 14 and holding the head 72 in position against the biasing force of the tubes 50 (FIG. 19).

When tubes 50 are elongated the platform 14 will be biased to return to center, but the neck muscles provide a counteracting force. This isometric strengthening treatment method will activate and strengthen the lateral flexors and rotators of the neck. The treatment is performed with the platform biased toward either direction to train both sides of the neck. Preloading of the platform may be executed by the patient or the therapist assisting the patient. Isometric holds can also be performed in a similar fashion with the patient sidelying to strengthen the neck flexors and extensors. Note that it is advantageous for the patient 70 to wear band 76 to provide friction between the head 72 and the platform 14 for increased traction.

Figure 20:
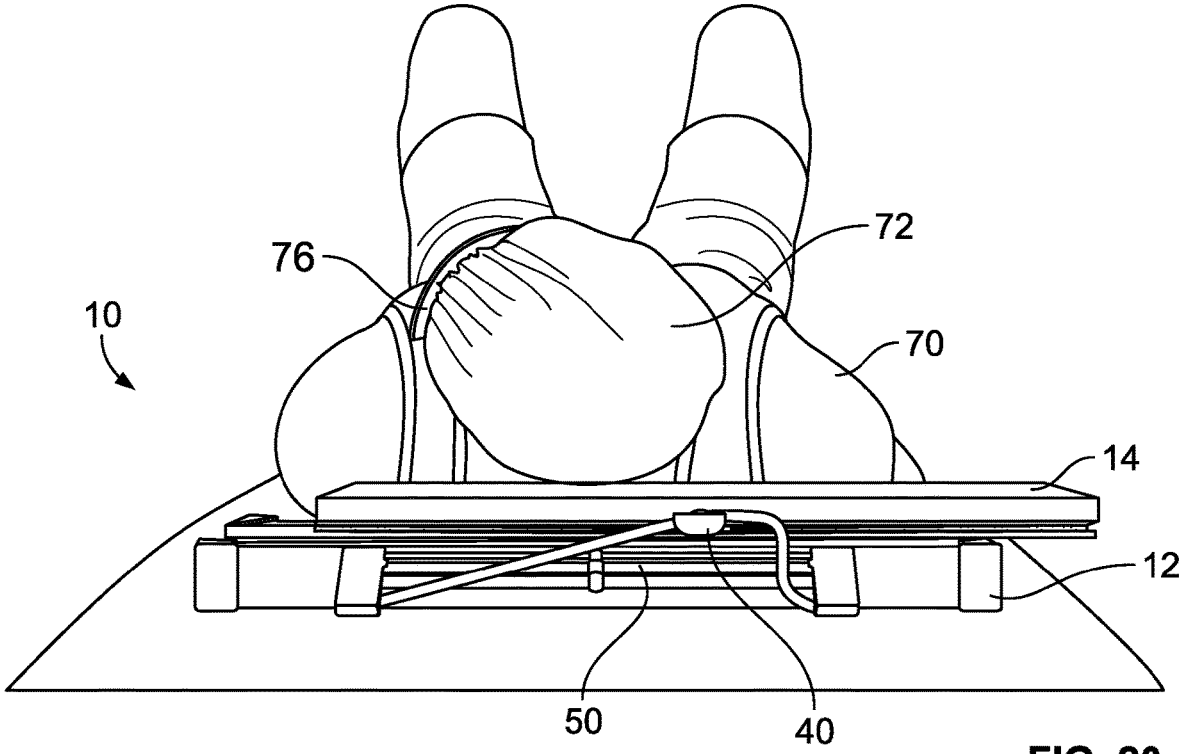
Figure 21:
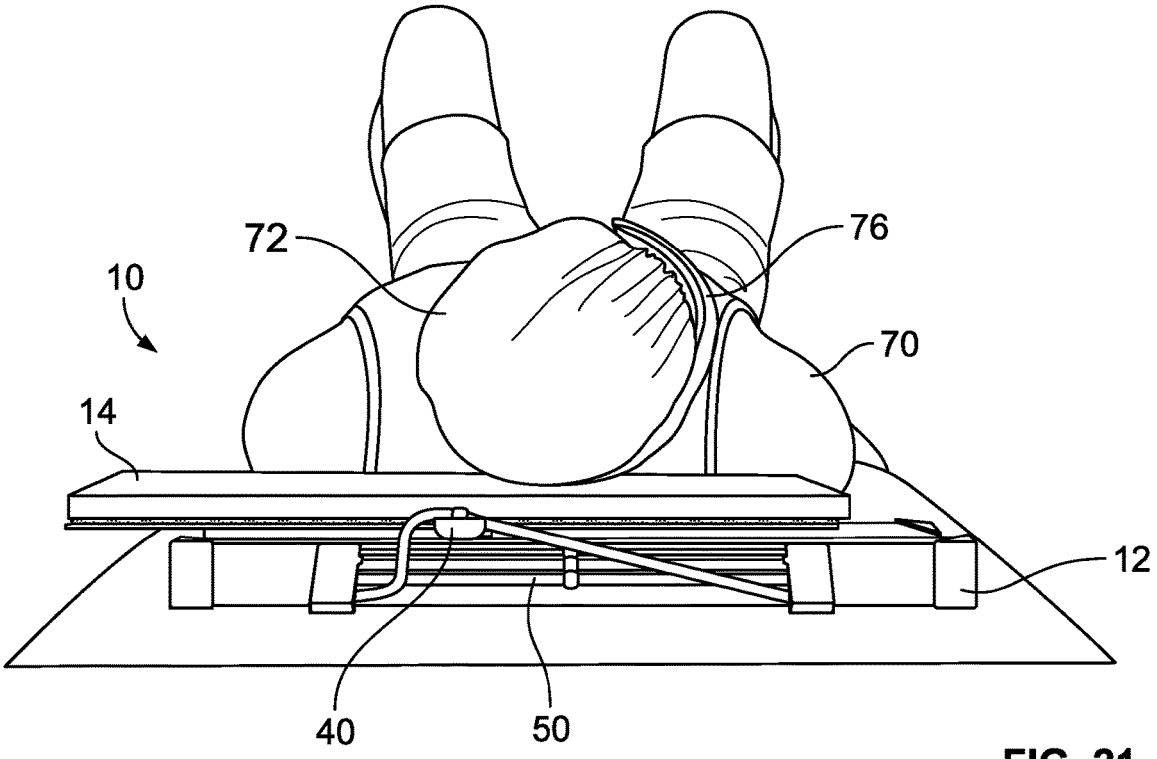

FIGS. 20 and 21 illustrate an example rotational strengthening treatment method using device 10. The example method may comprise:

connecting one or more tubes 50 to catch or catches 40 to resist free sliding motion of the platform 14 relative to the base 12;

with the patient 70 supine, positioning device 10 perpendicular to the patient's spine and beneath the head 72;

resting the patient's head 72 (but not the neck) centered on the platform 14 with the platform centered on the base 12;

rotating the head 72 in opposite directions (FIGS. 20 and 21) about the transverse plane against the biasing force of the tubes 50.

In this example treatment method, the tube or tubes 50 are elongated upon motion of the head, creating a force to load the neck rotator muscles concentrically. On the return motion, the rotator muscles are loaded eccentrically. Note that it is advantageous for the patient 70 to wear band 76 to provide friction between the head 72 and the platform 14 for increased traction.

Another example rotational strengthening method using device 10 may comprise:

connecting one or more tubes 50 to catch or catches 40 to resist free sliding motion of the platform 14 on the base 12;

with the patient supine, positioning device 10 perpendicular to the patient's spine and beneath the head;

sliding the platform toward one end of the base 12 against the biasing force of tubes 50 (see FIG. 18);

engaging said head 72 with said platform 14 holding the platform 12 against the biasing force of tubes 50, (FIG. 19);

releasing the platform 12 and rotating the head so as to center the platform 14 on the base 12;

rotating the head in the opposite direction to move the platform 14 back to one end of the base 12.

Rotation of the head in this treatment method effects concentric and eccentric rotator strengthening unilaterally. The treatment is performed bilaterally to load both the right and left rotators. Note that it is advantageous for the patient 70 to wear band 76 to provide friction between the head 72 and the platform 14 for increased traction.

Figure 22:
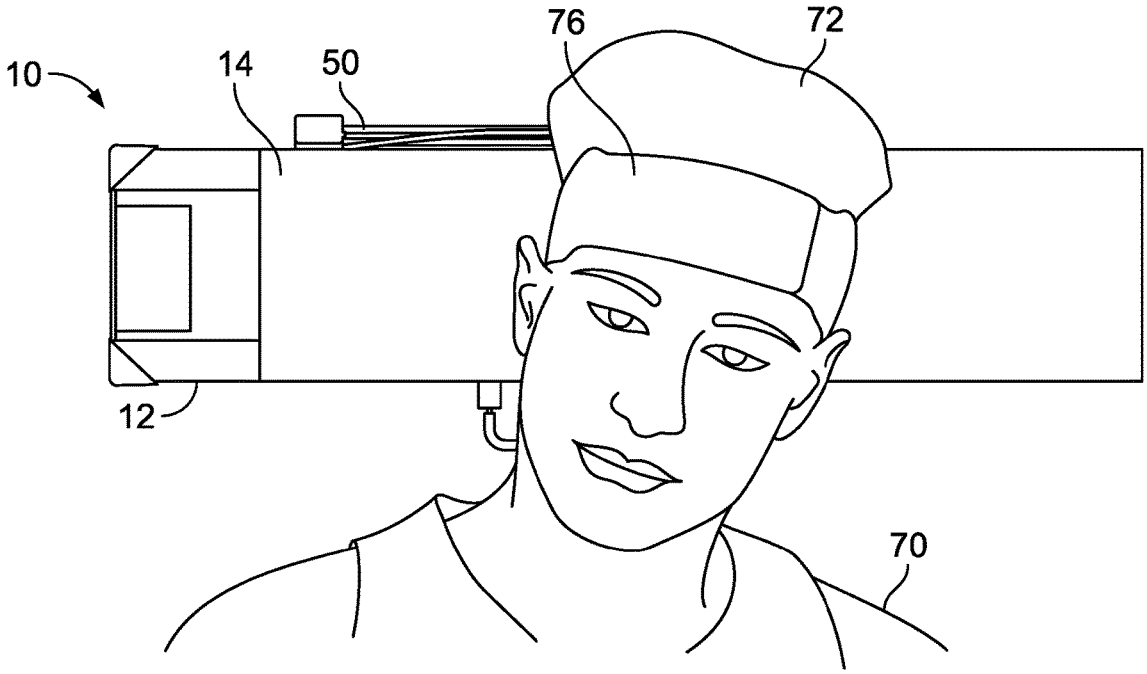
Figure 23:
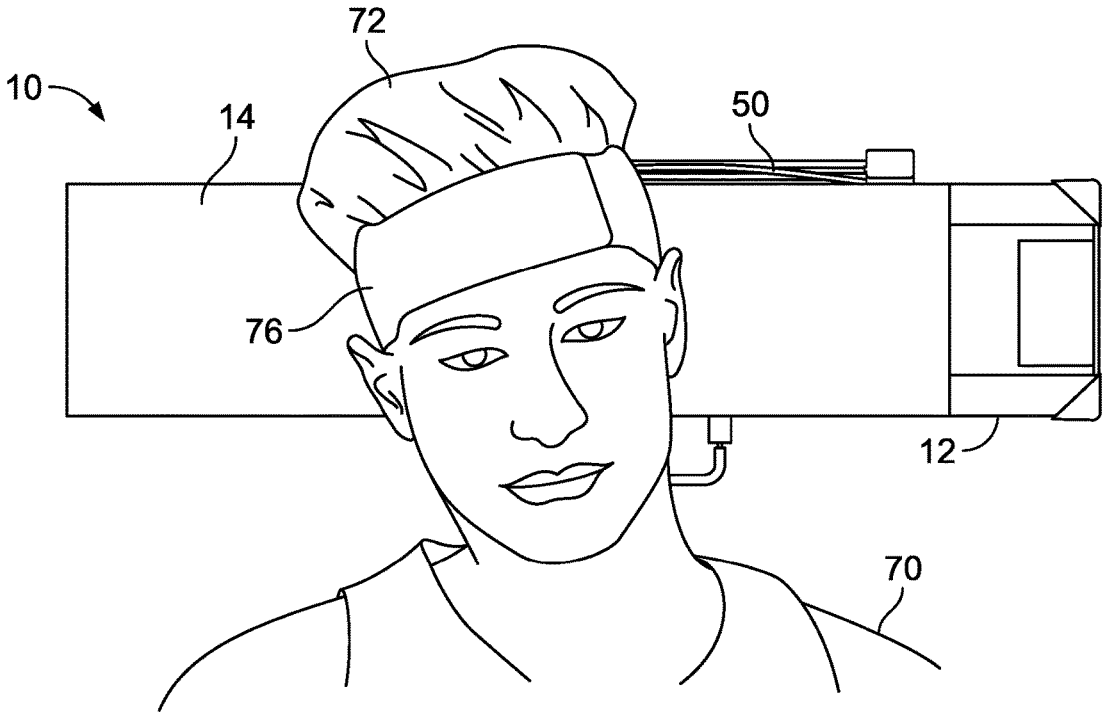

FIGS. 22 and 23 illustrate an example lateral flexion strengthening treatment method using device 10. The example method may comprise:

connecting one or more tubes 50 to catch or catches 40 to resist free sliding motion of the platform 14 on the base 12;

with the patient 70 supine, positioning device 10 perpendicular to the patient's spine and beneath the head 72;

resting the patient's head 72 (but not the neck) centered on the platform 14 with the platform centered on the base 12;

laterally flexing the head 72 in opposite directions about the frontal plane against the biasing force of the tubes.

As the head is laterally flexed and the platform slides in the same direction, the tube or tubes 50 are elongated, creating a force to load the neck lateral flexors muscles concentrically. On the return motion the same muscles are loaded eccentrically. Note that it is advantageous for the patient 70 to wear band 76 to provide friction between the head 72 and the platform 14 for increased traction.

Another example lateral flexion strengthening method using device 10 may comprise:

connecting one or more tubes 50 to catch or catches 40 to resist free sliding motion of the platform 14 on the base 12;

with the patient 70 supine, positioning device 10 perpendicular to the patient's spine and beneath the head 72;

sliding the platform 14 toward one end of the base 12 against the biasing force of tubes 50 (FIG. 18);

engaging the head 72 with the platform 14;

holding the platform 14 against the biasing force of tubes 50;

releasing the platform 14 and laterally flexing the head 72 so as to center the platform 14 on the base 12;

laterally flexing the head in the opposite direction to move the platform 14 back to one end of the base 12.

This example effects unilateral lateral flexor strengthening and is performed bilaterally to load both the right and left lateral flexors. Note that it is advantageous for the patient 70 to wear band 76 to provide friction between the head 72 and the platform 14 for increased traction.

Figure 24:
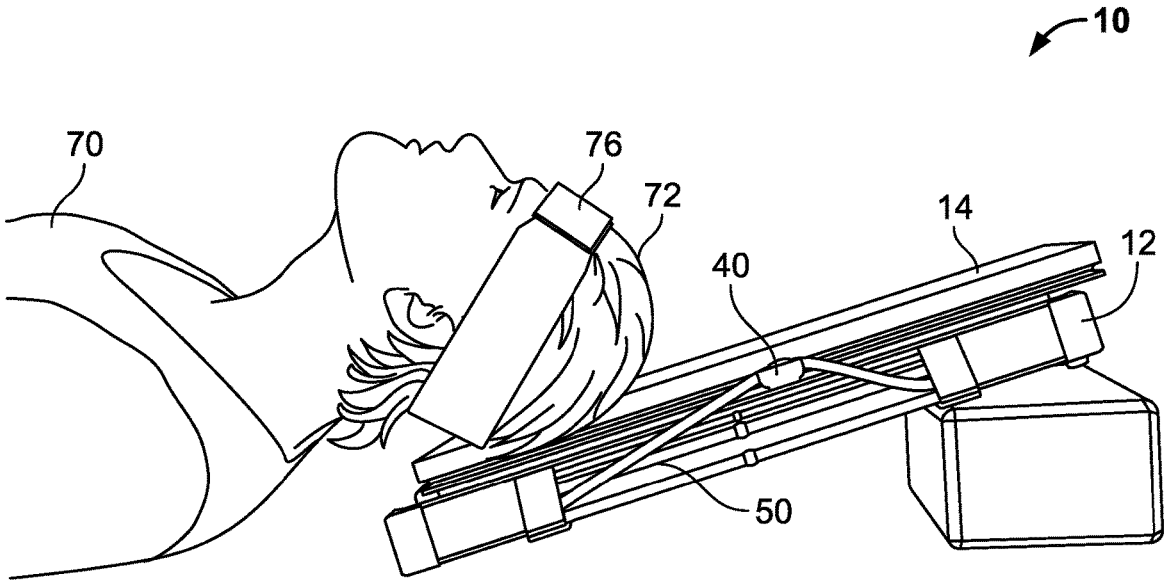
Figure 25:
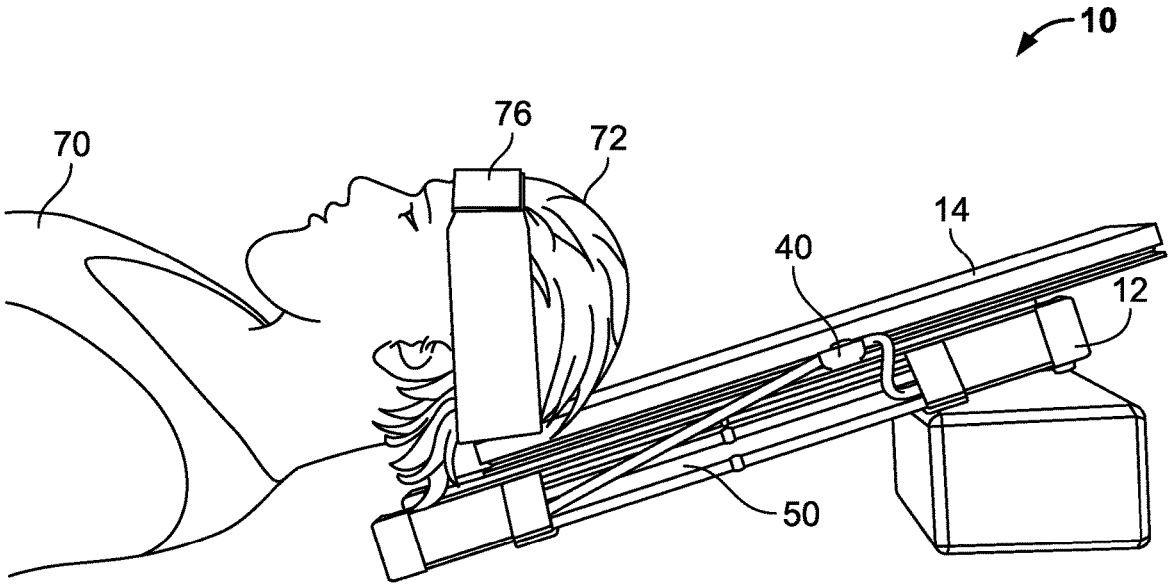
Figure 26:
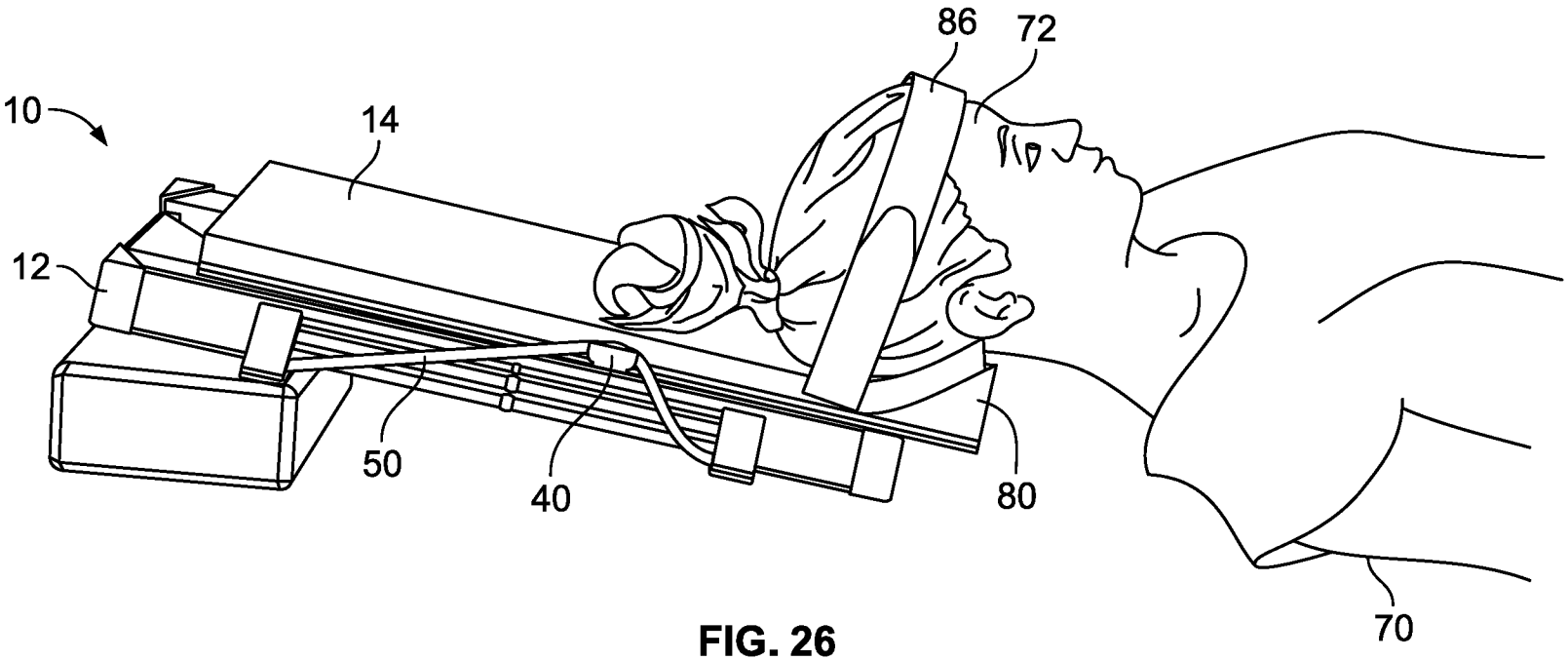

FIGS. 24 and 25 illustrate an example flexion/extension strengthening treatment method using device 10. The example method may comprise:

connecting one or more tubes 50 to catch 40 to resist free sliding motion of the platform 14 on the base 12;

with the patient 70 supine, positioning device 10 parallel to the patient's spine with one end of device 10 elevated;

resting the patient's head 72 (but not the neck) on the platform 14 at the lower (non-elevated) end with the platform 14 centered on the base 12;

flexing and extending the head 72 (FIGS. 24 and 25).

Flexing and extending the head 72 results in motion of platform 14 in the opposite direction of head motion. Flexing the neck loads the neck flexors concentrically and returning to the start position loads the neck flexors eccentrically. Extending the neck from the start position loads the neck extensors in a similar fashion. Note that it is advantageous for the patient 70 to wear band 76 to provide friction between the head 72 and the platform 14 for increased traction.

FIG. 26 illustrates an example mechanical traction treatment method using device 10. The example method may comprise:

positioning the cradle 80 at one end of the platform 14;

elevating the opposite end of the device 10 with the cradle 80 positioned at the lower (non-elevated) end;

with the patient 70 supine, positioning device 10 parallel to the patient's spine;

resting the head 72 (but not the neck) within the cradle 80;

tightening the strap 86 around the head 72;

attaching one or more tubes 50 to the catch 40;

moving the base 12 relative to the platform 14 in a direction away from the patient to apply a traction force; or moving the platform 14 relative to the base 12 in a direction toward the patient to apply the traction force; or moving the patient 70 away from the base 12 with the head 72 in the cradle 80 to apply the traction force.

The patient's head and neck should be relaxed during this treatment.

What is claimed is:

1. A therapy device, said therapy device comprising:

an elongate base;

a platform mounted on said base and movable relatively thereto lengthwise along said base; and a biasing mechanism acting between said base and said platform for resisting motion of said platform relatively to said base, said biasing mechanism comprising:

a first anchor mounted on said base;

a second anchor mounted on said base in spaced relation to said first anchor;

a catch mounted on said platform and positionable between said first and second anchors;

a plurality of springs, each said spring comprising an elastic tube and having a first end attached to said first anchor, a second end attached to said second anchor, and an intermediate point between said first and second ends attachable to said catch, wherein said catch comprises a body defining a channel extending lengthwise to said base, said channel receiving said intermediate point of at least one of said elastic tubes.

2. The device according to claim 1, further comprising:

a guide track positioned on said base, said guide track extending lengthwise along said base, said platform slidably engaging said guide track.

3. The device according to claim 2, wherein:

said guide track comprises first and second rails mounted in spaced relation along opposite sides of said base, said first and second rails extending lengthwise along said base; and said platform comprises a plurality of wheels rotatably mounted on said platform in spaced relation to one another, said wheels engaging said first and second rails and thereby permitting sliding motion of said platform relatively to said base.

4. The device according to claim 1, further comprising:

a substrate mounted on said platform, said platform being positioned between said substrate and said base.

5. The device according to claim 4, wherein said substrate comprises a cushion.

6. The device according to claim 4, further comprising a fastener positioned between said platform and said substrate, said fastener permitting removal and reattachment of said substrate to said platform.

7. The device according to claim 6, wherein said fastener comprises a hook and loop fastener having a plurality of hooks positioned on one of said platform or said substrate and a plurality of loops positioned on another of said platform or said substrate, said hooks engaging said loops for releasably retaining said substrate to said platform.

8. The device according to claim 4, wherein said substrate comprises a friction inducing surface facing away from said platform.

9. The device according to claim 8, further comprising a band positionable around a head of a patient, said band having an outwardly facing surface engageable with said friction inducing surface of said substrate.

10. The device according to claim 9, wherein said outwardly facing surface of said band comprises a second friction inducing surface.

11. The device according to claim 1, wherein said first and second anchors each comprise a gusset attached to said base, each said gusset defining a plurality of openings, each said opening receiving said first or said second end of one of said elastic tubes.

12. The device according to claim 11, wherein each said opening comprises a slot extending from an edge of said gusset.

13. The device according to claim 12, further comprising a respective retainer plate attached to each said gusset, each said retainer plate being movable between an open position providing access to said slots, and a closed position thereby closing said slots.

14. The device according to claim 11, wherein each said elastic tube comprises a first bead positioned proximate to said first end thereof and a second bead positioned proximate to said second end thereof, each said bead engaging one of said gussets.

15. The device according to claim 1, further comprising a cradle, said cradle being mountable on said platform for receiving a head of a patient.

16. The device according to claim 15, wherein said cradle comprises a concave surface.

17. The device according to claim 16 wherein said cradle comprises a strap attached to said cradle, said strap adapted to encircle said head and cinch said head to said cradle.

18. The device according to claim 15, wherein said cradle is mountable between said platform and a cushion positioned overlying said platform.

19. The device according to claim 1, wherein said biasing mechanism is mounted on a first side of said base and a second biasing mechanism is mounted on a second side of said base opposite to said first side.

20. The device according to claim 1, further comprising a handle attached to said base.

21. The device according to claim 1, wherein each said spring has a respective spring constant, said respective spring constants being different from one another.

22. The device according to claim 1, wherein:

each said elastic tube comprises a bead positioned at said intermediate point;

said body comprises a cavity intersected by said channel, said cavity receiving one of said beads when one of said elastic tubes is received within said channel.

23. A method for treating rotation range of motion of a head of a patient using said device according to claim 1, said method comprising:

disconnecting all said springs from said catch to allow free sliding motion of said platform relatively to said base;

with said patient supine, positioning said device perpendicular to said patient's spine and beneath said head;

resting said head on said platform with said platform centered on said base;

rotating said head left and right, said platform sliding beneath said head in response.

24. A method for treating lateral flexion range of motion of a head of a patient using said device according to claim 1, said method comprising:

disconnecting all said springs from said catch to allow free sliding motion of said platform relatively to said base;

with said patient supine, positioning said device obliquely to said patient's spine and beneath said head;

resting said head on said platform with said platform centered on said base;

flexing said head laterally in said direction of motion of said platform relatively to said base, thereby allowing pure frontal plane motion, said platform sliding beneath said head in response.

25. The method according to claim 24, further comprising positioning said device at an angle of 30° perpendicular to said patient's spine.

26. A method for treating flexion/extension range of motion of a head of a patient using said device according to claim 1, said method comprising:

disconnecting all said springs from said catch to allow free sliding motion of said platform relatively to said base;

with said patient supine, positioning said device parallel to said patient's spine with an end of said device elevated;

with said platform centered on said base, resting said head on said platform;

flexing and extending said head, said platform sliding beneath said head in response.

27. A method of isometric strengthening treatment of a neck of a patient using said device according to claim 1, said method comprising:

connecting one or more said springs to said catch to resist free sliding motion of said platform relative to said base;

with said patient supine, positioning said device perpendicular to said patient's spine and beneath said head;

sliding said platform toward one end of said base against said biasing force of said spring or springs;

engaging said head with said platform;

holding said platform against said biasing force of said spring or springs;

releasing said platform and holding said head in position against said biasing force of said spring or springs.

28. A method of rotational strengthening treatment of a neck of a patient using said device according to claim 1, said method comprising:

connecting one or more of said springs to said catch to resist free sliding motion of said platform relative to said base;

with said patient supine, positioning said device perpendicular to said patient's spine and beneath said head;

resting said head on said platform with said platform centered on said base;

rotating said head in opposite directions about said transverse plane against said biasing force of said spring or springs, said platform sliding beneath said head in response.

29. A method of rotational strengthening treatment of a neck of a patient using said device according to claim 1, said method comprising:

connecting one or more of said springs to said catch to resist free sliding motion of said platform on said base;

with said patient supine, positioning said device perpendicular to said patient's spine and beneath said patient's head;

sliding said platform toward one end of said base against said biasing force of said springs;

engaging said head with said platform;

holding said platform against said biasing force of said spring or springs;

releasing said platform and rotating said head so as to center said platform on said base;

rotating said head in an opposite direction to move said platform back toward said one end of said base.

30. A method of lateral flexion strengthening treatment of a neck of a patient using said device according to claim 1, said method comprising:

connecting one or more of said springs to said catch to resist free sliding motion of said platform on said base;

with said patient supine, positioning said device perpendicular to said patient's spine and beneath said patient's head;

resting said patient's head on said platform with said platform centered on said base;

laterally flexing said head in opposite directions about said frontal plane against said biasing force of said springs, said platform sliding beneath said head in response.

31. A method of lateral flexion strengthening of a neck of a patient using said device according to claim 1, said method comprising:

connecting one or more of said springs to said catch to resist free sliding motion of said platform on said base;

with said patient supine, positioning said device perpendicular to said patient's spine and beneath said patient's head;

sliding said platform toward one end of said base against said biasing force of said spring or springs;

engaging said head with said platform;

holding said platform against said biasing force of said spring or springs;

releasing said platform and laterally flexing said head so as to center said platform on said base;

laterally flexing said head in an opposite direction to move said platform back toward said one end of said base.

32. A method of flexion/extension strengthening treatment of a neck of a patient using said device according to claim 1, said method comprising:

connecting one or more of said springs to said catch to resist free sliding motion of said platform on said base;

with said patient supine, positioning said device parallel to said patient's spine with one end of said device elevated;

resting said patient's head on said platform with said platform centered on said base;

flexing and extending said head, said platform sliding beneath said head in response.

33. A method of mechanical traction treatment using said device according to claim 1, said device further comprising a cradle, said cradle being mounted on said platform for receiving a head of a patient, said method comprising:

positioning said cradle at one end of said platform;

with said patient supine, positioning said device parallel to said patient's spine;

resting said head within said cradle;

attaching one or more of said springs to said catch;

moving said base relative to said platform in a direction away from said patient to apply a traction force; or moving said platform relative to said base in a direction toward said patient to apply said traction force; or moving said patient away from said base with said head in said cradle.

34. The method according to claim 33, further comprising elevating an opposite end of said device from said one end.

35. The method according to claim 34, wherein said device further comprises a strap attached to said cradle, said strap adapted to encircle said head and cinch said head to said cradle, said method further comprising tightening said strap around said head.

36. A therapy device, said therapy device comprising:

an elongate base;

a platform mounted on said base and movable relatively thereto lengthwise along said base; and a biasing mechanism acting between said base and said platform for resisting motion of said platform relatively to said base, said biasing mechanism comprising:

a first anchor mounted on said base;

a second anchor mounted on said base in spaced relation to said first anchor;

a catch mounted on said platform and positionable between said first and second anchors; and a plurality of springs, each said spring comprising an elastic tube and having a first end attached to said first anchor, a second end attached to said second anchor, and an intermediate point between said first and second ends attachable to said catch, wherein said first and second anchors each comprise a gusset attached to said base, each said gusset having a respective retainer plate and defining a plurality of openings, each said opening comprises a slot extending from an edge of said gusset and each said opening receives said first or said second end of one of said elastic tubes, wherein each said retainer plate is movable between an open position providing access to said slots, and a closed position thereby closing said slots.

37. A therapy device, said therapy device comprising:

an elongate base;

a platform mounted on said base and movable relatively thereto lengthwise along said base;

a biasing mechanism acting between said base and said platform for resisting motion of said platform relatively to said base; and a cradle mountable on said platform for receiving a head of a patient;

a strap attached to said cradle, said strap adapted to encircle said head and cinch said head to said cradle;

said biasing mechanism comprising:

a first anchor mounted on said base;

a second anchor mounted on said base in spaced relation to said first anchor; and a spring, said spring comprising an elastic tube and having a first end attached to said first anchor, a second end attached to said second anchor, and an intermediate point between said first and second ends attached to said platform.

* * * * *